US005412152A

United States Patent [19]

Kageyama et al.

[11] Patent Number: 5,412,152

[45] Date of Patent: May 2, 1995

[54] DEVICE FOR FORMING TONE SOURCE DATA USING ANALYZED PARAMETERS

[75] Inventors: Yasuo Kageyama; Shigeki Fujii; Yasushi Ohtani, all of Hamamatsu, Japan

[73] Assignee: Yamaha Corporation, Japan

[21] Appl. No.: 963,445

[22] Filed: Oct. 15, 1992

[30] Foreign Application Priority Data

| | | | |
|---|---|---|---|
| Oct. 18, 1991 | [JP] | Japan | 3-271183 |
| Oct. 29, 1991 | [JP] | Japan | 3-282987 |
| Oct. 29, 1991 | [JP] | Japan | 3-282988 |
| Oct. 29, 1991 | [JP] | Japan | 3-282989 |
| Oct. 29, 1991 | [JP] | Japan | 3-282990 |
| Nov. 1, 1991 | [JP] | Japan | 3-287965 |
| Nov. 1, 1991 | [JP] | Japan | 3-287966 |
| Nov. 1, 1991 | [JP] | Japan | 3-287967 |
| Nov. 12, 1991 | [JP] | Japan | 3-295772 |

[51] Int. Cl.[6] ..... G10H 1/057; G10H 1/12; G10H 1/46; G10H 7/12

[52] U.S. Cl. ..... 84/607; 84/622; 84/627; 84/629; 84/633

[58] Field of Search ..... 84/601–608, 84/627, 629, 622–625, 659–665, DIG. 9, 633

[56] References Cited

U.S. PATENT DOCUMENTS

| | | | |
|---|---|---|---|
| 3,809,786 | 5/1974 | Deutsch . | |
| 4,018,121 | 4/1977 | Chowning . | |
| 4,383,462 | 5/1983 | Nagai et al. . | |
| 4,691,608 | 9/1987 | Sasaki et al. | 84/607 X |
| 4,909,118 | 3/1990 | Stevenson | 84/622 |
| 5,029,509 | 7/1991 | Serra et al. . | |
| 5,086,475 | 2/1992 | Kutaragi et al. | 84/603 X |
| 5,225,618 | 7/1993 | Wadhams | 84/604 X |
| 5,248,845 | 9/1993 | Massie et al. | 84/622 |
| 5,300,724 | 4/1994 | Medovich | 84/627 X |

*Primary Examiner*—Stanley J. Witkowski
*Attorney, Agent, or Firm*—Graham & James

[57] ABSTRACT

Tone waveform data is divided into plural data segments, so that frequency and magnitude of respective spectra contained therein are analyzed for each of the data segments. Analyzation parameters indicative of the frequency and magnitude of the respective spectra for each said data segment which has been obtained through the analyzation is stored into a memory. The analyzation parameter for each data segment is sequentially read out from the memory, and the tone waveform data is reanalyzed on the basis of the read-out parameter. To control the frequency of a resulting tone, a data shift circuit may be provided which serves to shift the value of the frequency data contained in the analyzation parameters. Further, an interpolation circuit may be provided which performs interpolations between frequency data and/or magnitude data of respective spectra of a certain waveform, and frequency data and/or magnitude data of respective spectra of another waveform, so as to form frequency data and magnitude data of respective spectra of a new waveform.

44 Claims, 23 Drawing Sheets

| FREQ | MAG |
|---|---|
| F 0,0 | M 0,0 |
| F 0,1 | M 0,1 |
| ⋮ | ⋮ |
| F 0,n | M 0,n |

FRAME 0

| FREQ | MAG |
|---|---|
| F 1,0 | M 1,0 |
| F 1,1 | M 1,1 |
| ⋮ | ⋮ |
| F 1,n | M 1,n |

FRAME 1

---

| FREQ | MAG |
|---|---|
| F m,0 | M m,0 |
| F m,1 | M m,1 |
| ⋮ | ⋮ |
| F m,n | M m,n |

FRAME m m : FRAMENUMER n : CHANNELNUMER

VOICE DATA

FRAME PROGRESS
CONTROL SECTION 15 t1 : TIME OF SHIFT TO NEXT PITCH

11 : DECAY LEVEL OF CURRENT TONE (-)
12 : INCREASE LEVEL OF NEXT TONE (+/-)

t1 : DECAY TIME OF CURRENT TONE
t2 : INCREASE TIME OF NEXT TONE

NOTE TIMING CHART

DEVICE FOR FORMING TONE SOURCE DATA USING ANALYZED PARAMETERS

BACKGROUND OF THE INVENTION

This invention is concerned with a device which stores, as tone source data, data obtained through analyzation of original tone waveform data for each data segments thereof for subsequent tone synthesis and which thus is suitable for use as a tone source device in electronic musical instruments or the like.

To this day, there have been proposed various tone signal forming techniques that are suitable for use in electronic musical instruments. Most typical of such techniques are FM (Frequency Modulation) type tone source and waveform memory type tone source techniques. The FM type tone source technique synthesizes (frequency-modulates) a plurality of basic or original signals at various magnitude in accordance with various algorithms (U.S. Pat. No. 4,018,121, for example). The waveform memory type tone source technique, on the other hand, stores tones of a natural musical instrument etc. in time series in advance, and, when actually generating reproduced tones, it sequentially reads out the stored tones to form tone waveform data (U.S. Pat. No. 4,383,462, for example). In addition to the above-mentioned techniques, Fourier synthesis type tone source technique is well-known in the art (U.S. Pat. No. 3,809,786). Another synthesis type tone source techniques is also known from U.S. Pat. No. 5,029,509.

With the FM type tone source, waveform can be controlled in various manners with substantial flexibility by adjusting parameters, but it is difficult to control waveform so as to achieve a desired tone color, and hence satisfactory reproduction of natural musical instrument tones can hardly be achieved. With the waveform memory type tone source, satisfactory reproduction of natural musical instrument tones can be achieved, but it is difficult to process waveform, and hence tone color can not be varied as desired. Further, both the FM type and waveform memory type tone sources can not realize an intermediate tone color from those of plural tone data to a satisfactory degree. That is to say, the FM type tone source has inherent adverse characteristics that an intermediate value of plural parameters never corresponds to an intermediate value of plural tone colors, and the waveform type tone source can never generate significant data even if it obtains an intermediate data value at each sampling time.

In addition, with the Fourier synthesis tone source respective Fourier components of a tone to be synthesized are undesirably fixed in their frequency relations with respect to each other, and it is not possible to vary the frequencies of the individual components as desired. Further, the Fourier synthesis tone source is basically not arranged in such a manner that arbitrary or desired tone waveform data provided from outside are freely sampled for subsequent analyzation and then tone data of desired characteristics are freely formed on the basis of the analyzed data.

Moreover, in general, the waveform type tone source requires looped readout of the waveform memory because its memory capacity for storing the waveform data is limited. So, this tone source suffers from the disadvantage that connect ion points of the looped readout will result in unnaturalness of generated tones.

In the meantime, in the case of wind instruments such as a saxophone, rise time and duration of the attack portion of a generated tone will substantially vary depending on whether the instrument is played strongly or weakly. So, in order to approximate such variations using the waveform memory type tone source, it is necessary to expand or contract the data readout time length. However, the prior art waveform memory type tone source is not satisfactory in that it can not effectively change the attack speed etc. in response to the intensity of a performance action, because a change in the readout speed will entail an undesirable change in the tonal frequency.

Further, in the case where vibrato, which is a well-known method for tonal decoration, is to be effected by the FM type tone source, there will arise the inevitable problem that the performance tends to become extremely monotonous because the FM modulation is made by the use of regularly formed triangle wave, sine wave or the like. In addition, if vibrato effect is previously provided to the waveform data itself, the source can not achieve vibrato control, nor can it provide good matching of the vibrato waveform in the event that repeated readout of the waveform data is started halfway rather than the very beginning.

SUMMARY OF THE INVENTION

Therefore, it is an object of the present invent ion to provide a tone source device which allows a high-quality tone equivalent to that of natural musical instruments to be effectively generated with improved reproducibility and also allows the waveform configuration of the generated tone, i.e. tone color to be freely processed with improved controllability and which further allows storage capacity of memory or the like to be minimized.

It is a further object of the present invention to provide such arrangements that facilitate the formation of a new tone waveform which is different from an original tone waveform input for analyzation (an intermediate tone waveform between the original waveform and other tone waveform, for instance).

It is a still further object of the present invention to provide arrangements that allow, using only a limited number of parameters (data indicative of spectrum frequency and magnitude), synthesization of a good-quality variable sustain sound.

It is a still further object of the present invention to provide such arrangements that achieves a smooth frequency change so as to allow the impartment of a legato performance effect in response to legato instructions, in the case where a tone synthesis is cart led out using analyzation parameters (data indicative of spectrum frequency and magnitude).

It is a still further object of the present invention to provide arrangements that allows a smoother legato by adjusting a change in analyzation parameters when legato is instructed.

It is a still further object of the present invention to, in the case where tone waveform is changed at a predetermined interval, variably control a tone waveform change interval in response to control data indicative of the intensity of a performance action by human such as breath touch or velocity.

It is a still further object of the invention to realize a natural vibrato.

It is still further object of the invention to variably control tone characteristics in diversified manners with increased ease.

It is still further object of the invention to provide various arrangements so as to improve controllability of tone waveform, in the case where a tone synthesis is performed by the use of analyzation parameter (data indicative of spectrum frequency and data).

To achieve one of the above-mentioned objects, a tone source device according to the present invention comprises a memory section for storing an analyzation parameter indicative of frequency and magnitude of respective spectra for each of plural data segments corresponding to a first tone waveform, the data segments being successive parts of the tone waveform, a reading section for sequentially reading out the analyzation parameter for each of said data segments, and a synthesization section for generating a resynthesized tone waveform data on the basis of the analyzat ion parameters read out from said memory section.

With the above-mentioned arrangement, because the plural data segments are successive parts of tone waveform data and an analyzation parameter obtained for each of the data segments and stored into the memory section, it is allowed to obtain high-quality analyzation parameters that correspond to a timewise change of the tone waveform configuration. Moreover, in this case, tone control can be performed with increased ease, simply by suitably varying the frequency data or magnitude data contained in the analyzation parameters. Therefore, it is allowed to form a synthesized tone waveform signal of high quality which requires only a small quantity of stored data and yet has increased controllability.

Further, to achieve another object of the invention, the tone source device may further comprise a spectrum envelope data supplying section for supplying spectrum envelope data of a second tone waveform that is different from the first tone waveform read out from said memory section, and a modification section for modifying magnitude data of respective spectra of the first tone waveform read out from said memory section, using the spectrum envelope data of the second tone waveform supplied by said spectrum envelope data supplying section, wherein said synthesization section forms new synthesized tone waveform data on the basis of frequency data of respective spectra of the first tone waveform read out from said memory section and the magnitude data of respective spectra modified by said modification section. As mentioned, because the magnitude data of the respective spectra in the first tone waveform is modified using the spectrum envelope data of the second tone waveform and a new tone waveform data is formed on the basis of the modified frequency data, it is made possible to easily form a new (intermediate) tone waveform.

Further, to achieve another object of the invention, the tone source device may further comprise a storage section for storing spectrum ratio envelope data indicative of a ratio of the spectrum envelope of the second tone waveform relative to a spectrum envelope of said first tone waveform, and a modification section for modifying the magnitude data of the respective spectra of the first tone waveform read out from said memory section, by the spectrum ratio envelope data stored in said storage section, wherein said synthesization section synthesizes new tone waveform data on the basis of the frequency data of respective spectra of the first tone waveform read out from said memory sect ion and the magnitude data of respective spectra modified by said modification section. The new synthesized tone waveform formed in this manner is caused to have the characteristics possessed by the first tone waveform with its spectrum magnitude being made dependent on the spectrum envelope of the second tone waveform, and thus it is allowed to apply tone control suitable for the second tone waveform to the first tone waveform.

To achieve another object of the invention, the tone source device may further comprise a control section for controlling said reading section to repeatedly read out the analyzation parameters corresponding to one or more of sa id data segments. With such an arrangement, synthesis of a sustain sound can be effected by repeated readout of one or more of the data segments. Accordingly, it is made possible to form a good-quality synthesized sustain sound to which desired change can be imparted, using only a limited quantity of parameters (data indicative of spectrum frequency and magnitude). The control section may be capable of variably designating the data segments corresponding respectively to a start point and an end point for repeated readout of the the analyzation parameters, and said control section controls said reading section to repeatedly read out the analyzation parameters for a plurality of the data segments from the data segment corresponding to the start point to the data segment corresponding to the end point. The control sect ion may also be capable of changing the start and end points during the repeated readout of the the analyzation parameters. Further, the control section may be capable of designating, as the data segment corresponding to the start point, such a data segment that should, in a normal readout mode, be read out later than the data segment corresponding to the end point, so that the readout of the analyzation parameters for the plurality of the data segments is performed in an opposite direction to a direction followed in the normal readout mode.

To achieve another object of the invention, the tone source device may further comprise a change section for, when a tone pitch of a tone to be generated is desired to be changed legato from a first tone pitch to a second tone pitch, progressively changing, with a predetermined characteristic, a value of the frequency data contained in the analyzation parameter that is read out from said memory section, from a value corresponding to the first tone pitch to a value corresponding to the second tone pitch. With this arrangement, legato effect can be imparted with increased ease. Besides, pitch change in the generated tone signals can be effected in a smooth manner because the value of frequency data contained in the analyzation parameter changes smoothly. The device may further comprise a tone volume control section for controlling, with a predetermined characteristic, a tone volume of the synthesized tone waveform data formed by said synthesization section, when a tone pitch change control is performed by said change section. This allows a smoother legato.

To achieve another object of the invention, the tone source device may be arranged in such a manner that the memory section stores the analyzation parameter for each of said data segments, with respect to plural tone waveform data different at least in tone pitch, and said reading section reads out the analyzation parameters for each of said data segments, with respect to the tone waveform data corresponding to the tone to be generated, and it further comprise a control section for, when a tone pitch of a tone to be generated is desired to be changed legato from a first tone pitch to a second tone pitch, controlling said reading section to start reading out the analyzation parameters corresponding to the second tone pitch, from the data segment corresponding to a segment order of the data segment associated with the analyzation parameter that has been read out just then with respect to the first tone pitch. The segment order of the data segments substantially corresponds to the duration of tone generation. Therefore, when changing the pitch from the first pitch to the second pitch, readout of the analyzation parameter is started from the data segment corresponding to the segment order of the data segment that has been read out just then, with the result that legato performance can be done with more smoothness.

Preferred arrangement may be such that the control section controls said reading section so that if there is no data segment corresponding to said order with respect to the second tone pitch, said reading section starts reading out the analyzation parameters corresponding to the second tone pitch, from the data segment corresponding to a predetermined segment order. The device may further comprise a loop control section for controlling said reading section to repeatedly read out the analyzation parameters corresponding to one or more of the data segments, wherein said predetermined segment order is an order of the data segment corresponding to the start point for the repeated readout.

To achieve still another object of the invention, the tone source device may further comprise a section for supplying control data that is variable in control value represented thereby, and a control section for variably controlling an interval at which the analyzation parameter for each of said is data segments sequentially read out by said reading section. Because the interval at which the analyzation parameter for each data segment is sequentially read out is varied in accordance with the control data value, the interval at which tone waveform is changed can also be variably controlled freely in accordance with the control data indicative of the intensity of a performance action made by human such as breath touch or velocity, and besides, unwanted expansion/contraction can be completely prevented.

To achieve still another object of the invention, the tone source device may further comprise a vibrato analyzation section for analyzing a vibrato characteristic in the input tone waveform data so as to output vibrato waveform data corresponding to the analyzed vibrato characteristic, a vibrato memory section for storing the vibrato waveform data, a section for reading out the vibrato waveform data from the vibrato memory section, and a modulation section for modulating frequency data contained in the analyzation parameters read out from said memory section, by the vibrato waveform data, whereby said synthesization section forms synthesized tone waveform data having a vibrato effect using the modulated frequency data. Because of the above-mentioned arrangement in which vibrato characteristic of the input tone waveform data is analyzed, vibrato waveform data corresponding to the analyzed vibrato characteristic is stored, and then this vibrato waveform data is utilized to impart vibrato effect to a generated tone, it made possible to provide vibrato with naturalness.

To achieve still another object of the invention, the tone source device may further comprise an adjustment section for adjusting at least one of frequency data and magnitude data that are contained in the analyzation parameter read out from said memory section, so that synthesized tone waveform data is formed by said synthesization section using the adjusted analyzation parameters. This allows tone characteristics to be variably controlled in diversified manners with increased ease. In accordance with a preferred embodiment, the adjustment section may comprise a section for supplying as a time function a control parameter for respective spectra, and section for changing at least one of the frequency data and magnitude data contained in the analyzation parameter in accordance with the supplied control parameter. Further, the adjustment section may comprise a section for supplying a control parameter for each of the spectra as a function of control data provided from outside, and a section for changing at least one of the frequency data and magnitude data contained in the analyzation parameter for each said spectrum in accordance with the supplied control parameter. The control data provided from outside may be data provided in correspondence to the intensity of a performance action made by human such as breath touch or velocity. With the above-mentioned arrangement, it is made possible to receive desired or arbitrary tone waveform data provided from outside and to express the data in the form of analyzation parameters that are indicative of the frequency and magnitude of respective spectra and comprising only a limited quantity of data.

To achieve still another object of the invention, the tone source device may further comprise an analyzation section for dividing the data of the tone waveform into said plural data segments and analyzing each of said data segments to produce said frequency and magnitude of respective spectra contained therein.

To achieve still another object of the invention, the tone source device may further comprise a normalization section for normalizing original frequency data for each sa id spectrum obtained through the analyzation of said analyzation section, by shifting said original frequency data in accordance with a ratio of its fundamental frequency relative to a predetermined standard frequency, so that the frequency data normalized by said normalization section is stored into said memory section. Because of the arrangement, frequency data of the analyzation parameter to be stored into the memory section is caused to be normalized on the basis of the predetermined standard magnitude, and thus it is made possible to perform interpolation on the analyzation parameters between different tone waveforms and to carry out processes as for forming analyzation parameters of a new tone waveform with no significant problems. This is very advantageous in terms of waveform controllability.

The tone source device may further comprise a normalization section for normalizing, using a predetermined standard magnitude, original magnitude data for each said spectrum obtained through the analyzation of said analyzation section, so that the magnitude data normalized by said normalization section stored into said memory section. The predetermined standard magnitude may be a magnitude of an original fundamental frequency. The normalized magnitude data may advantageously be expressed in an absolute value by removing the positive or negative sign therefrom.

To achieve still another object of the invention, the tone source device may further comprise means for shifting the frequency data for the respective spectra obtained through the analyzation of said analyzation section, in accordance with the predetermined standard frequency, a section for synthesizing, via the synthesization section, tone waveform data on the basis of the shifted frequency data for the respective spectra and magnitude data corresponding thereto, and a section for reanalyzing, via the analyzation section, the synthesized tone waveform data for each group of plural said data segments so as to obtain frequency data of the respective spectra having said standard frequency as a fundamental frequency. In accordance with a preferred embodiment, the normalized frequency data and magnitude data for plural tone waveforms are stored into the memory section, and the tone source device may further comprise an interpolation section for performing interpolation on the normalized frequency data and magnitude data between different tone waveforms, to thereby obtain frequency data and magnitude data of the respective spectra of a new tone waveform. Further, the frequency data and magnitude data of the respective spectra of the new tone waveform obtained by said interpolation section may be stored into said memory section.

To achieve still another object of the invention, the analyzation section may comprise a first analyzation process section having a plurality of band-pass filter section that have pass bands corresponding to respective ones of predetermined frequency bands, the first analyzation process section inputting the data of the tone waveform into each of said band-pass filter section and analyzing spectrum frequency and magnitude of a passed output from each of said band-pass filter section, and a second analyzation process section for, when any component corresponding to a same spectrum frequency is analyzed by said first analyzation process section across different ones of said said band-pass filter section, combining magnitude data of each said component associated with the same spectrum frequency to form frequency data and magnitude data of one spectrum so as to obtain frequency data of respective spectra having said standard frequency as a fundamental frequency. Because, when any component corresponding to a same spectrum frequency is analyzed by said first analyzation process section across different ones of said said band-pass filter section, they are combined as frequency and magnitude data for one spectrum, it is made possible to perform interpolation on the analyzation parameters between different tone waveforms and to carry out processes as for forming analyzation parameters of a new tone waveform with no significant problems. This is very advantageous in terms of waveform controllability.

To achieve still another object of the invention, the analyzation section may comprise a first analyzation process section having a plurality of band-pass filter section that have pass bands corresponding to respective ones of predetermined frequency bands, said first analyzat ion process sect ion inputting the data of the tone waveform into each of said band-pass filter section and analyzing spectrum frequency and magnitude of a passed output from each of said band-pass filter section, a first control section for causing said first analyzation section to analyze the data segments of the tone waveform which are input at individual ones of plural time zones that are sequentially timewise spaced from each other, a determination section responsive to analyzation data obtained for each of the time zones for determining that a certain spectrum frequency has moved from a band corresponding to a first one of said band-pass filters over to a band corresponding to a second one of said band-pass filters when a first one of said time zones changes to a second one of said time zones, and a second control section responsive to the determination of said determination section for carrying out an exchange of the pass bands between said first and second ones of said band-pass filters and then instructing said first analyzation process section to reanalyze the spectrum frequency and magnitude associated with either one of said first and second ones of said time zones. With such an arrangement, the same band-pass filters can be employed for analyzat ion even when overtone frequency of a certain spectrum order is temporarily varied due to fluctuation etc., and thus no disturbance will occur in the spectrum order. This is extremely convenient for subsequent processes or controls such as interpolation operations.

Now, the preferred embodiments of the present invention will be described in greater detail in conjunction with the accompanying drawings.

DETAILED DESCRIPTION OF THE PREFERRED EMBODIMENTS

Figure 1:
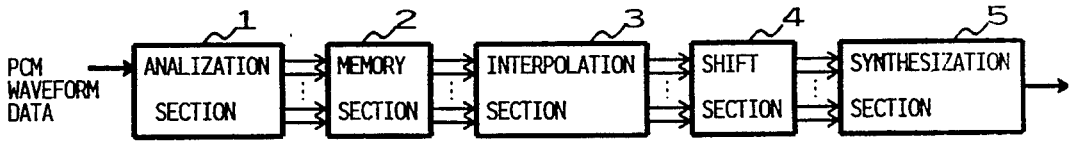
FIG. 1 is a block diagram showing the basic structure of an analyzation/synthesization type tone source device to which the principle of the invention is applied.

FIG. 1 is a block diagram showing a basic circuitry structure of an analyzation/synthesization type tone source device to which the principle of present invention is applied.

Figure 2A:
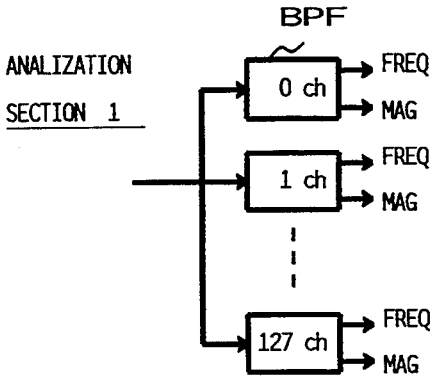
FIG. 2A shows an example structure of the analyzation section of the tone source device shown in FIG. 1.
Figure 2B:
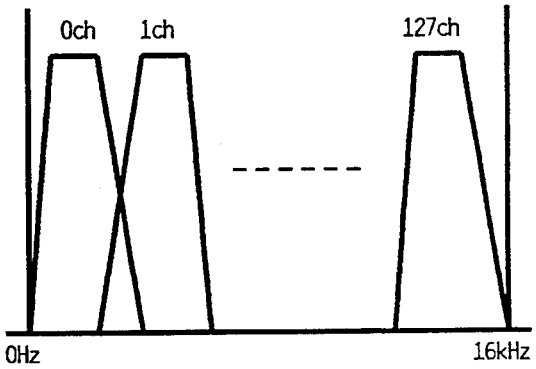
FIG. 2B illustrates example band characteristics of the individual band-pass filters shown in FIG. 2A.

As shown, the analyzation/synthesization type tone source device generally comprises an analyzation section 1, a memory section 2, an interpolation section 3, shift section 4 and a synthesization section 5. FIG. 2A shows an example structure of the analyzation section 1 which is composed of plural (128 in the illustrated example) band-pass filters (hereinafter referred to as "BPF" for the sake of convenience) connected in parallel relation to each other. The individual BPFs are identified by the numbers of associated channels 0–127. As shown in FIG. 2B, each of the BPFs has a band width of 125 Hz, and the filtering bands of the BPFs are established to fall within a frequency range from 0 Hz to 16 kHz in a sequential manner such that the filtering band of channel 0 has a filtering band of 0–125 Hz, channel 1 125–250 Hz, channel 3 250–375 Hz and so on. In addition, each of the BPFs has a FFT (Fast Fourier Transform) function and is capable of detecting frequency data and magnitude data MAG of a frequency spectrum that passes through the BPF. The frequency is detected as a deviation or difference from the central frequency of the band, but the frequency data FREQ can be obtained in absolute value by adding the deviation to the band central frequency. It should be understood that the analyzation section 1 may be constructed of other known components than the above-mentioned BPF array, such as a high-speed FFT analyzer. Further, the number of the channels is not restricted to 128, and also the band width of each BPF is not restricted 125 Hz.

Figure 3:
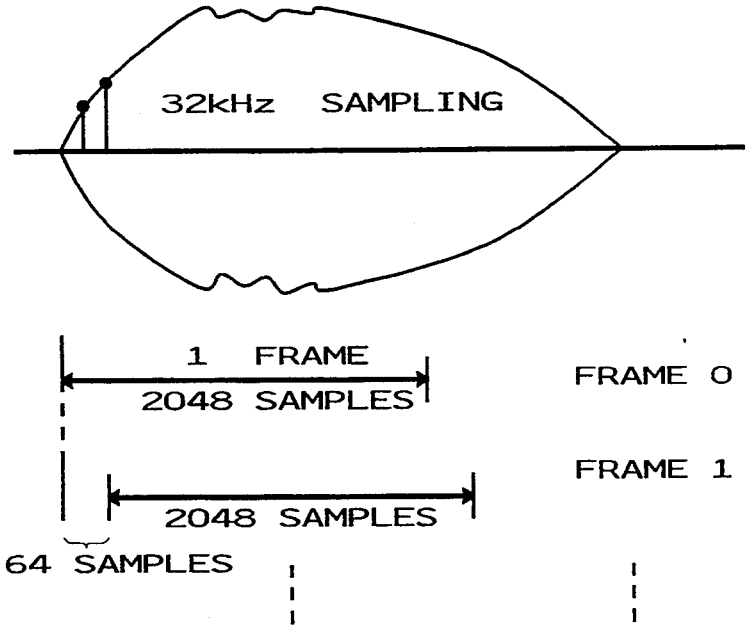
FIG. 3 illustrates example PCM waveform data input to the tone source device.

To the analyzation section 1 is input PCM (Pulse Code Modulated) waveform data. The PCM waveform data is such data that is sampled in accordance with sampling clock pulses of 32 kHz. The analyzation section 1 handles 2.048 samples as one unit data (or one frame), and each frame is output every 64 samples so that adjacent frames are output in partly overlapped relation with each other with a deviation of 64 samples, as clearly shown in FIG. 3. Each channel of the analyzation section 1 outputs frequency data FREQ and magnitude data MAG whenever sampling data for one frame are input thereto. It should now be noted that the number of samples to make up one frame is not restricted to 2, 048, and also the interval between the frames is not restricted to 64.

Figures 4, 5:
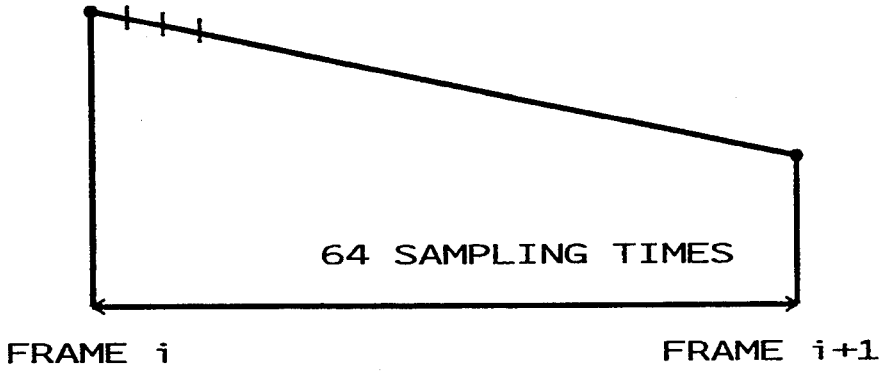
FIG. 4 illustrates the stored contents of the memory section of the tone source device.
FIG. 5 is a diagram showing how the interpolation section of the tone source works.

As shown in FIG. 4, the memory section 2 stores frequency data Fm, n and magnitude data Mm, n of each channel in a table format for each frame. Table group of plural frames which correspond to a single waveform data will hereinafter be referred to as "voice data". The voice data are stored in the memory section 2 in corresponding relation to individual tone colors. In the case where a so-called multisampling technique (technique which stores plural waveforms corresponding to one tone color for each tone range and magnitude), plural voice data corresponding to one tone color will be stored.

The above-mentioned waveform analysis (transformation into voice data) by the analyzation section 1 and storage into the memory section 2 of the data are preliminary processes to be carried out before a performance. The interpolation section 3 is a circuit section which, when reading out voice data to form waveform data, performs interpolation operations so as to form voice data for each timing of sampling clock pulses. In other words, new frame data is read out every 64 clock pulses, but frequency data and magnitude data at 63 sampling times between the individual frames are calculated by linear interpolation of two frame data before and after, as best seen in FIG. 5. Thus, in practice, data of adjacent frames i and i+1 are simultaneously read out for interpolation, so that interpolated data for one frame are obtained. Such interpolation is performed for each channel using data of the same channel. Data calculated in this manner are provided to the shift section 4.

The shift section 4 is a circuit section which shifts only the frequency data so as to produce a tone of a pitch (frequency) designated by a keyboard or other pitch designation means. Shift amount is determined on the basis of the frequency of the sampled waveform data and the designated frequency. However, provision of the shift section 4 is not necessary in the case where voice data corresponding to all the keys (pitch) are stored by multisampling. Further, as the shift section 4, arithmetic operation circuits other than the data shift circuit described may be employed, such as a multiplier.

The synthesization section 5 is a circuit section which synthesizes the frequency data and magnitude data of the respective channels into one waveform data. Such synthesization can be done by reverse FFT synthesization or by additive synthesization.

The voice data stored in the memory section 2 are read out and are subject to interpolation and shift processes, and then the data are synthesized into tone waveform data. Accordingly, the memory section 2, interpolation section 3, shift section 4 and synthesization section 5 need to be operated on the real time basis as the performance proceeds. Therefore, musical instrument that is used for the performance need not include the analyzation section 1.

The above-mentioned analyzation/synthesization type tone source is capable of generating an electronic tone by sampling an actual tone of a natural or acoustic musical instrument and also allows the sampling waveform data to be processed to a great degree.

Figure 6:
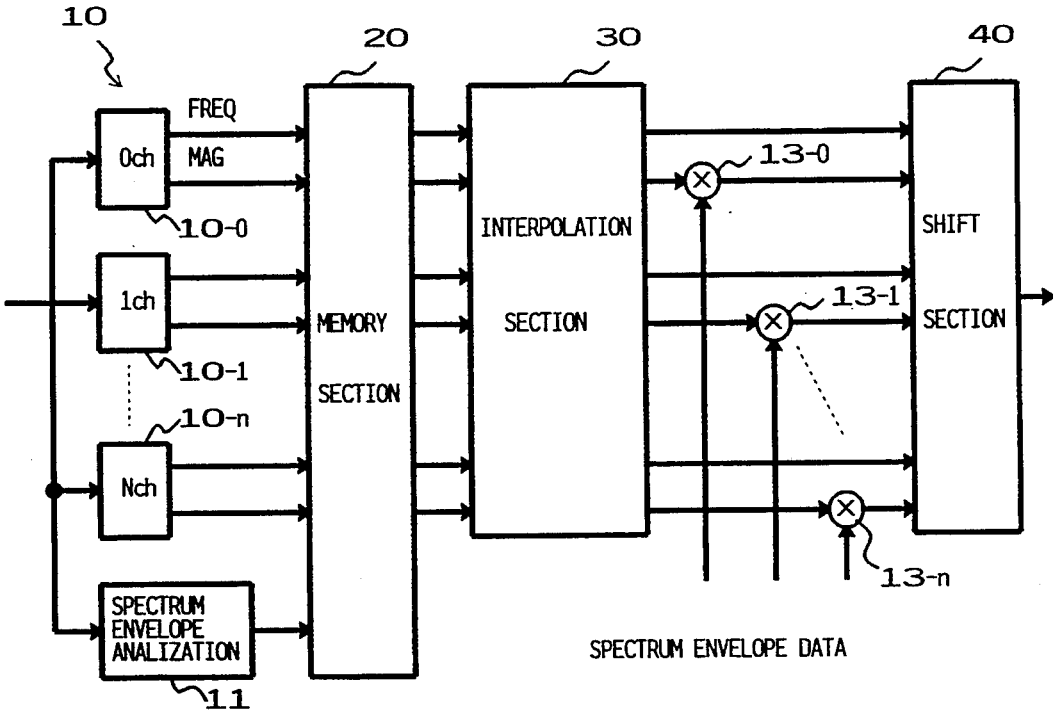
FIG. 6 is a block diagram illustrating an example of detailed arrangements employed in a part of the tone source device in accordance with the invention.
Figure 7:
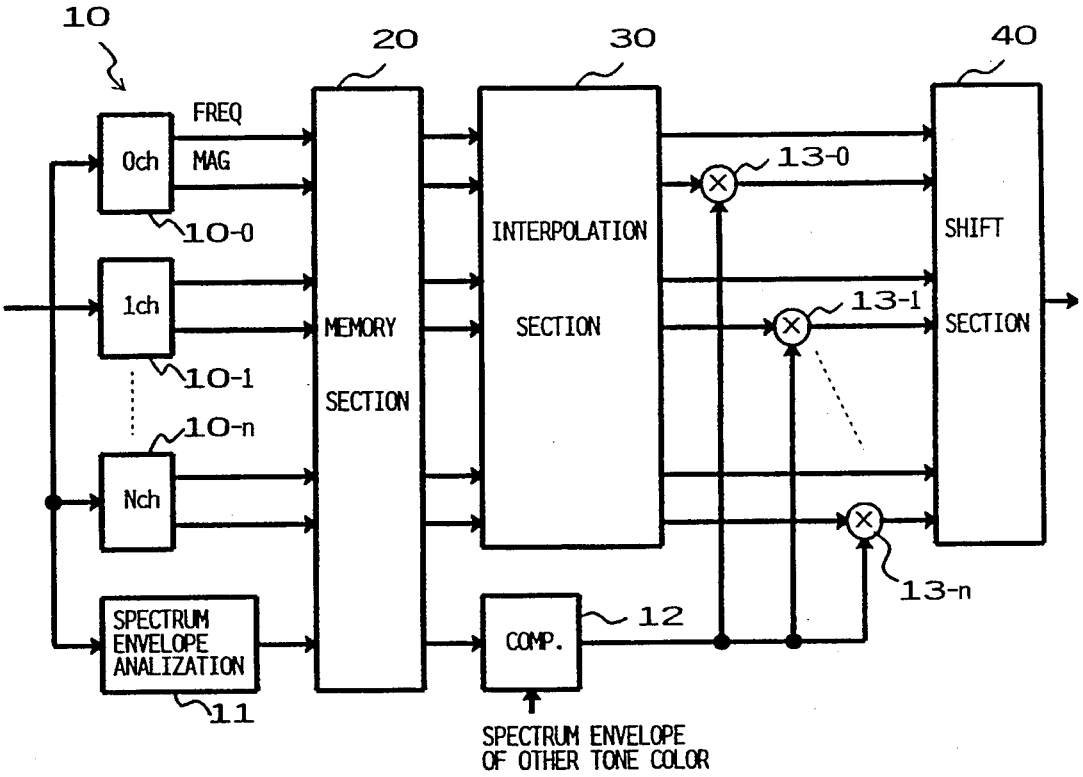
FIG. 7 is a block diagram illustrating alternative arrangements employed in the part of the tone source device.
Figure 8:
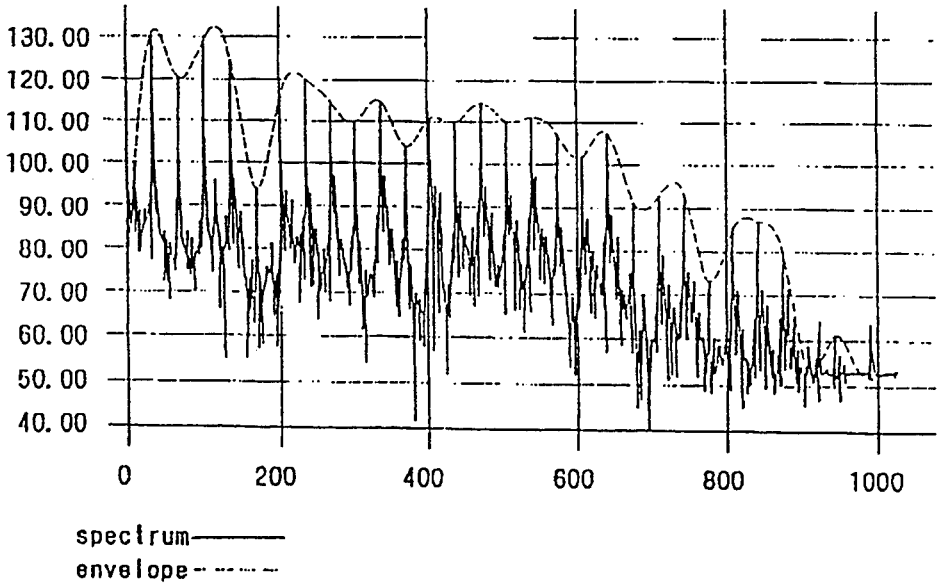
FIG. 8 is a graphic representation of an example spectrum distribution of tone waveform data.
Figure 9:
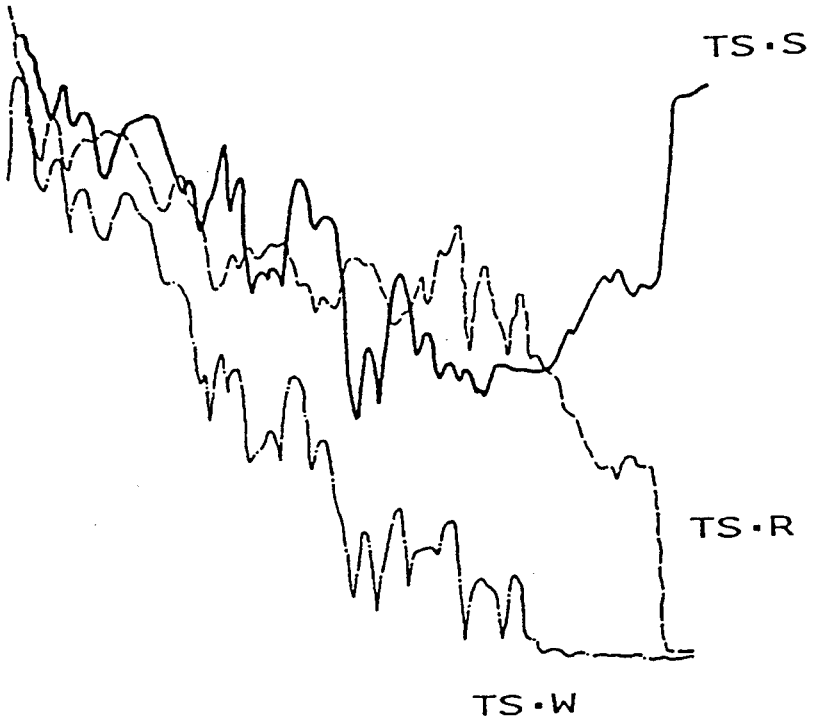
FIG. 9 is a graphic representation of spectrum envelopes of plural tone waveform data and a curve indicative of the ratio between them.

FIGS. 6 and 7 are diagrams illustrating partial structures of the analyzation/synthesization type tone source according to an embodiment of the present invention. FIG. 8 is a diagram illustrating a spectrum distribution of tone waveform data to be analyzed. FIG. 9 is a diagram illustrating spectrum envelope curves obtained when a natural musical instrument (tenor is saxophone) played strongly (as shown by solid line TS.S) and weakly (as shown by one dot-and dash line TS.W), and their ratio data (shown by dotted line TS.R)

An analyzation section 10 includes BPFs 10-1 to 10-n of oth channel to nth (=128th) channel and an envelope analyzation circuit 11. Each of the BPFs 10-1 to 10-n outputs frequency data FREQ and magnitude data MAG of a spectrum contained in its filter band, and the envelope analyzation circuit 11 calculates a curve that smoothly connects local peaks in the amplitude distribution (solid line in FIG. 8) of each spectrum. The calculated curve is represented as magnitude-comparison data on the assumption that the magnitude of a fundamental frequency (fundamental tone) is 1. That is to say, the curve is normalized because the magnitudes of individual tone waveform data are different from each other. The above mentioned operations are performed on a plurality of tone waveform data,and the data are respectively stored into a memory section 20. Although it is most desirable that the spectrum envelope data are analyzed, extracted and stored frame by frame, only spectrum envelope data of the sustain portion of a tone may be extracted to eliminate the time required for analyzation. It is assumed in this embodiment that only one spectrum envelope data of the sustain portion of a tone is extracted and stored.

With the memory section 20 is connected an interpolation section 30. The interpolation section 30 performs interpolation operations on the frequency data and magnitude data of sampling times between the individual frames, and the section 30 outputs the thus interpolated data. For each channel, a multiplier 13-0 to 13-n is connected to a magnitude data transmission path between the interpolation section 30 and a shift section 40. In the example of FIG. 6, each of the multipliers 13-0 to 13-n multiplies the magnitude data of each spectrum of one i.e., first tone waveform by the spectrum envelope data of another second tone waveform. It is assumed here that, because the spectrum envelope data are data covering all bands of a tone, each of the multipliers 13-0 to 13-n multiplies is given such ratio data that corresponds to its filter band.

When it is desired that one of analyzation parameters stored in the memory section 20 is read out to form a synthesized tone (tone waveform data), it is sufficient that the magnitude data and frequency data are sequentially read out and input to the interpolation section 30. On the other hand, when it is desired that one new synthesized tone is formed from analyzation parameters of two kinds of tones (first and second tones), the magnitude data of the first tone (reference tone) is modified by the spectrum envelope data of the second tone (evaluation tone) using the frequency data of the first or reference tone, and then these data are synthesized. In other words, the frequency data and magnitude data of the first or reference data are output from the interpolation section 30 at each sampling time, and this magnitude data is multiplied by the spectrum envelope data of the second or evaluation tone. In this manner, a new synthesized tone is provided which has characteristics of the first tone in terms of the spectrum frequency data but has characteristics of the second tone in terms of the magnitude data. In this instance, the spectrum envelope data of the second tone that are to be input to the multipliers 13-0 to 13-n may be those read out from the memory section 20, or alternatively may be those provided from outside.

Referring now to the example of FIG. 7, there is provided a comparison circuit 12. This comparison circuit 12 compares spectrum envelope data of desired first and second tone waveforms and then outputs ratio data as shown by dotted line TS.R in FIG. 9. Ratio data of two spectrum envelopes which are output from the comparison circuit 12 are input to multipliers 13-0 to 13-n for multiplication by magnitude data of the first tone waveform. With this arrangement, the magnitude data can be modified into magnitude data of the second tone waveform (evaluation tone) with higher accuracy than in the example of FIG. 6.

As the result of the multiplication, a synthesized tone is provided whose spectrum frequency is that of the reference tone (first tone) but whose envelope of the magnitude data is that of the evaluation tone (second tone). Because of this, intermediate tones between the tones can be generated.

It should be understood that, in the case where only the spectrum envelope data of the steady portion of a tone is provided as the spectrum envelope data, the ratio data output from the comparison circuit 12 are ratio curve data (TS.R of FIG. 9) of spectrum magnitude at the steady port ion, but such data may also be employed in the case where synthesization is made for waveform of the attack portion, release portion etc. But, spectrum envelope data may be extracted not only from the steady portion but also from the attack and release portions. Further, between two analyzation parameters of which spectrum patterns are identical or very similar to each other, synthesization may be made by applying the magnitude data of one parameter to the frequency data of the other parameter.

Moreover, although this embodiment is arranged in such a manner that the spectrum envelope is stored for each tone color, ratio data of two spectrum envelope data themselves, like ratio data TS.R of FIG. 9 may be stored.

According to the embodiment shown in FIGS. 1 to 9, the use of sampled data can generate with improved reproducibility tones of an natural musical instrument. Also, because waveform data are stored as analyzation parameters, a tone source device is provided which can achieve high-degree of tone color processings. Further, since the magnitude data of the first analyzation parameter can be added with the spectrum envelope data of the second analyzation parameter, generation of intermediate tone between these can be achieved.

Figure 10:
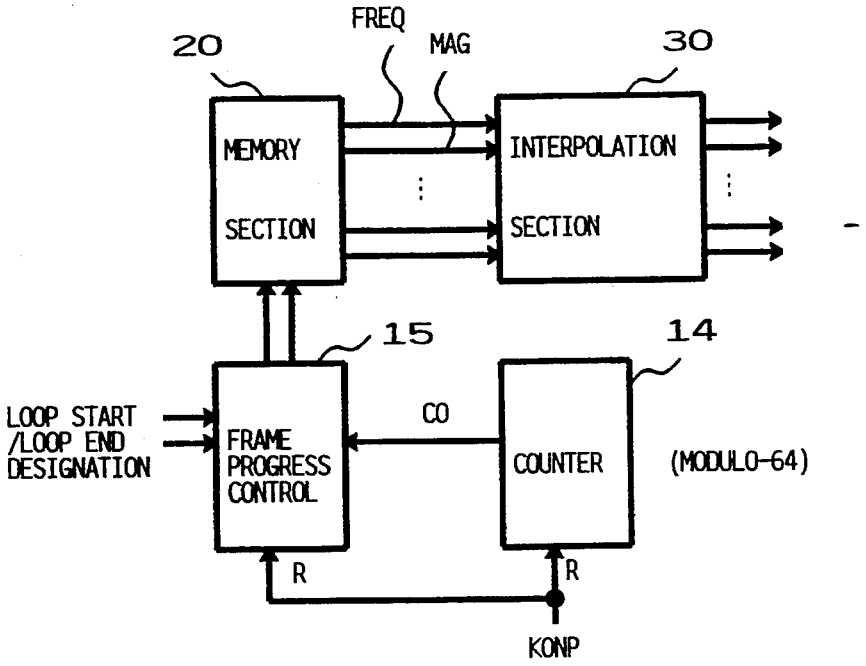
FIG. 10 is a block diagram illustrating an example of detailed arrangements employed in a part associated with the memory section and interpolation section shown in FIG. 1.
Figure 11:
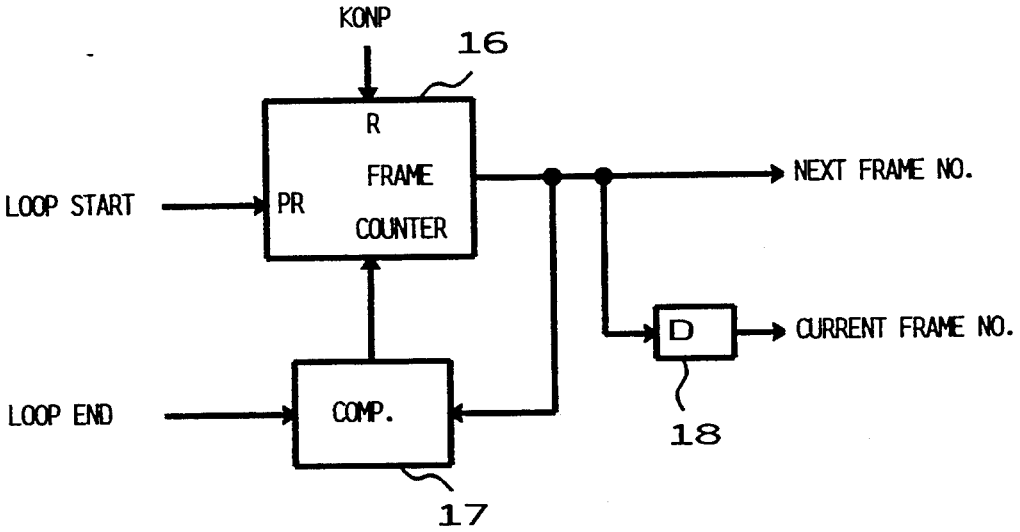
FIG. 11 is a block diagram illustrating an example of detailed structure of the frame progress control section shown in FIG. 10.

FIG. 10 shows a modification of the structure employed for the portions associated with the memory section 2 and interpolation section 3 in the analyzation/-synthesization type tone source device according to the embodiment of the invention. The modification is directed to repeatedly reading out data of one or more desired frames, and a counter 14 is connected to an interpolation circuit 30. The counter 14 is a modulo-64 counter which has a count capacity of 64 and capable of counting up in response to sampling clock pulses. Its count is provided to the interpolation circuit 30, while its carry signal is provided to a frame progress control section 15. An example structure of the frame progress control section 15 is shown in FIG. 11. This section 15 is a circuit section that designates specific frame data to be output from the memory section 20.

Figure 12A:
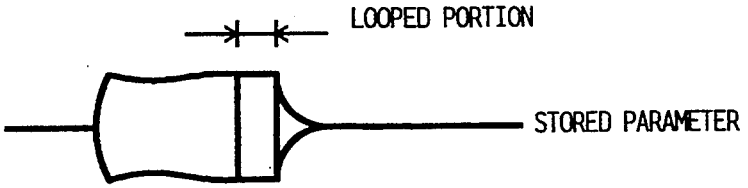
FIGS. 12A and 12B schematically illustrate how data is stored in the memory section of FIG. 10 and the looped readout of the data from the memory section is carried out.
Figure 12B:
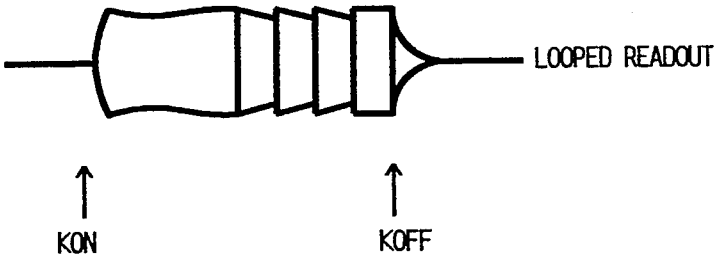

A frame counter 16 is counted up in response to the carry signal provided from the counter 14, and its count is given as a next frame number directly to the memory section 20 and also is fed to a one-stage delay circuit (shift register) 18. The one-stage delay circuit 18 outputs a current frame number to the memory section 20. A key-on pulse KONP is input to a reset terminal of the frame counter 16, while a loop-start frame number is input to a preset terminal of the frame counter 16. A comparison circuit 17 receives a loop-end frame number, as well as the output signal of the frame counter 16. When the count value of the frame counter 16 has become equal to the loop-end frame number, the comparison circuit 17 provides a load signal to the frame counter 16. Then, in response to a key-on event, a key-on pulse KONP is output to reset the frame counter 16 so that frame readout starts with frame 0. When the frame readout has progressed up to the loop-end frame, the loop-start frame number is preset by the load signal output from the comparison circuit 17 so that the frame counter 16 restart counting with the number. This operation is repeated as long as the key-on lasts. FIG. 12A schematically shows waveform data that corresponds to the parameters stored in the memory section 20, and FIG. 2B schematically shows the envelope of waveform obtained by the looped readout.

Figure 13A:
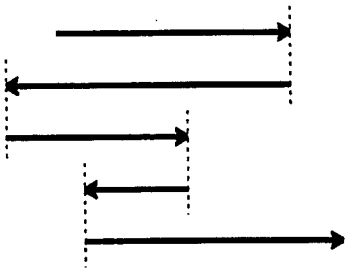
FIGS. 13A and 13B are diagrams explanatory of two typical loop readout techniques.
Figure 13B:
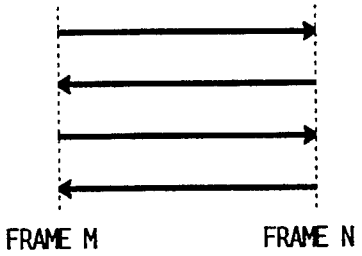

Note that the loop-start frame number and loop-end frame number may be fixed or may be varied for each voice. Further, although, in the above-mentioned embodiment, the data readout is always carried out in sequence, inverse readout may be done after the sequential readout as shown in FIG. 13A. Also, at that time, the loop-start frame number or loop-end frame number may be varied for each loop as shown in FIG. 13B.

However, looped portions must be smoothly connected with each other, and thus such frames i, j as to minimize next evaluation function are made the loop-start and loop-end frames, respectively.

1) In the case where evaluation is made using the magnitude data alone, the following formula is applied:

$$\min_j \sum_k (m_k^i - m_k^j)^2 \tag{1}$$

2) in the case where evaluation is made using the magnitude data and frequency data, the following formula is applied:

$$\min_j \left\{ \alpha \cdot \sum_k (f_k^i - f_k^j)^2 + \beta \cdot \sum_k (m_k^i - m_k^j)^2 \right\} \tag{2}$$

3) in the case where evaluation is made with respect to plural frames using the magnitude data alone, the following formula is applied:

$$\min_j \sum_1 \sum_k (m_k^{i+1} - m_k^{j+1})^2 \tag{3}$$

4) in the case where evaluation is made with respect to plural frames using the magnitude data and frequency data, the following formula is applied:

$$\min_j \left\{ \alpha \cdot \sum_1 \sum_k (f_k^{i+1} - f_k^{j+1})^2 + \beta \cdot \sum_1 \sum_k (m_k^{i+1} - m_k^{j+1})^2 \right\} \tag{4}$$

The formulae (2) and (4) are useful for a tone whose frequency changes, and particularly, formula (4) is useful for a tone having vibrato effect.

In accordance with the embodiment described above in conjunction FIGS. 10 to 13B, a tone source device is achieved which can reproduce tones of natural musical instrument or the like in a highly improved manner and also can accurately form a sustain tone. Moreover, as opposed to the prior art waveform memory technique, the embodiment synthesizes analyzation parameter after having been readout in a looped manner, thereby allowing tonal variation corresponding to the looped portion to be made in a smooth and natural manner.

Figure 14:
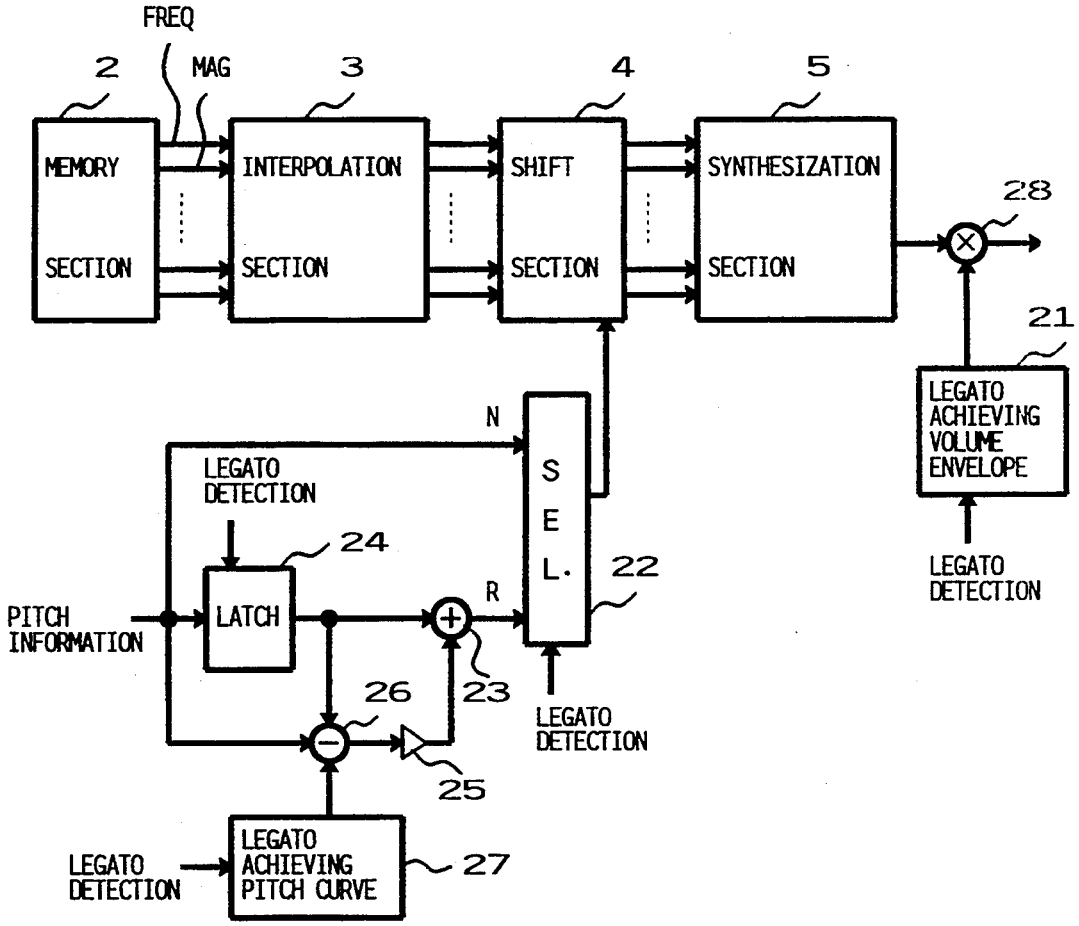
FIG. 14 is a block diagram illustrating an example of detailed arrangements employed in a part associated with the shift section of FIG. 1.

FIG. 14 shows another embodiment of the invention which performs a pitch control in accordance with legato technique. When a tone shift by legato is instructed in this tone source device, pitch shift control is made by sending smoothly-changing pitch information to a shift section 40 and also a tone volume is varied in accordance with this pitch control.

Figure 15:
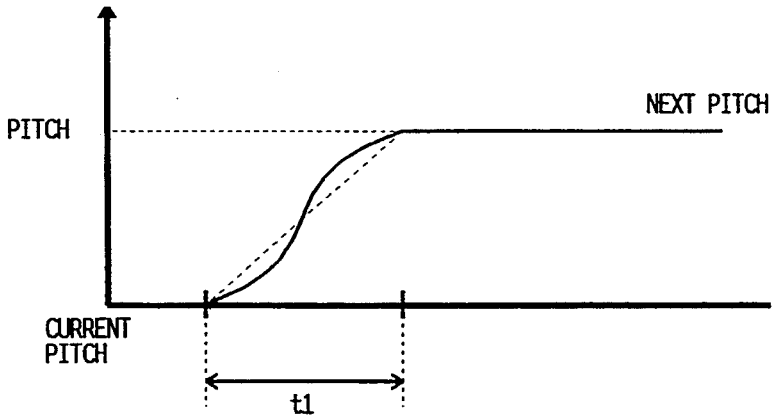
FIG. 15 is a graphic representation of an example of legato- achieving pitch curve data suitable for use in the embodiment of FIG. 14.

The pitch information is input to the shift section 40 via a selector 22. The shift section 40 shifts frequency data of analyzat ion parameters provided from an interpolation section 3 so that the frequency data matches a designated frequency. To one input terminal of the selector 22 is provided original pitch information directly from an unillustrated performance device, and to the other input terminal of the selector 22 is provided the original pitch information via an adder 23. A latch circuit 24 and a multiplier 25 are connected to the adder 23. When a legato detection signal is received, the latch circuit 24 latches pitch information of a tone designated immediately before the receipt of the legato detection signal. The multiplier 25 receives via a subtracter 26 a difference (pitch difference data) between pitch information of the last tone and pitch information of a new tone. Also, the multiplier 25 is connected with a legato-achieving pitch curve memory 27 which, when a legato detection is signal received, outputs a legato-achieving pitch curve data having a curve characteristic as shown in FIG. 15.

After having been multiplied by the above-mentioned pitch difference data, the curve data is added to the last pitch information by the adder 23. The legato-achieving pitch curve data represents a smooth curve as shown in FIG. 15 and thus allows a smooth pitch shift. It should be appreciated that various functions such as linear or exponential functions are applicable to the shift curve.

It should also be understood that legato is detected and thus legato detection signal is output, for example, when shift of keys activated on occurs in an a keyboard overlapping manner, when a succeeding key is activated before a preceding key is deactivated, or when a key operation is switched during a press-on state in a wind instrument type controller.

Further, in this tone source, a multiplier 28 is provided at the rear stage of a synthesization section 5, so that the multiplier 28 multiplies synthesized tone waveform data from the synthesization section 5, by legato-achieving tone volume envelope data. To this end, a legato tone volume envelope memory 21 is connected to the multiplier 28. This legato tone volume envelope memory 21 outputs legato-achieving tone volume envelope data in response to the receipt of a legato detection signal. The legato-achieving volume envelope data represents a waveform which has a dip or slope as shown in FIG. 16 in such a manner that tone volume is lowered at the intermediate-pitch time region in accordance with the pitch shift.

With such arrangement, instability of pitch can be eliminated.

Figure 16:
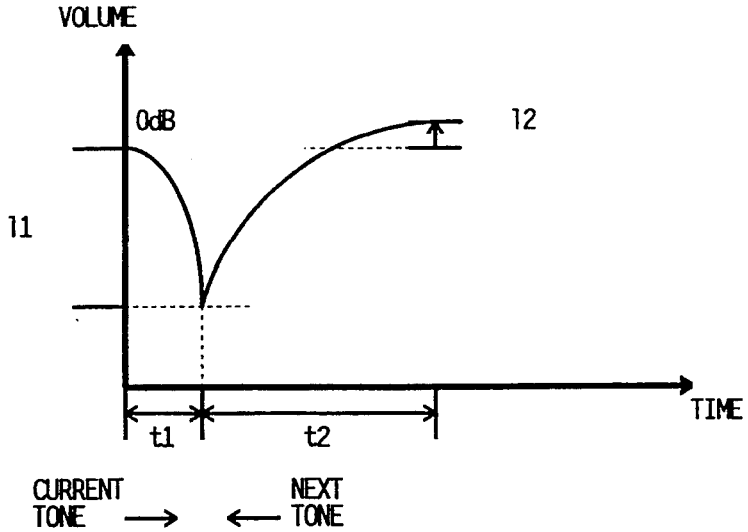
FIG. 16 is a graphic representation of an example of legato-achieving tone volume envelope data suitable for use in the embodiment of FIG. 14.

As described, according to the embodiment of FIGS. 14 to 16, the use of sampled data can reproduce tones of natural musical instrument etc. in an improved manner. Also, because waveform data are stored in the form of analyzation parameters, a tone source device can be achieved which provides high-degree processings of tone colors. Further, because legato-achieving pitch curve data and legato-achieving volume envelope data are stored and employed for control purposes, it is allowed to achieve a smooth legato effect.

Figure 17:
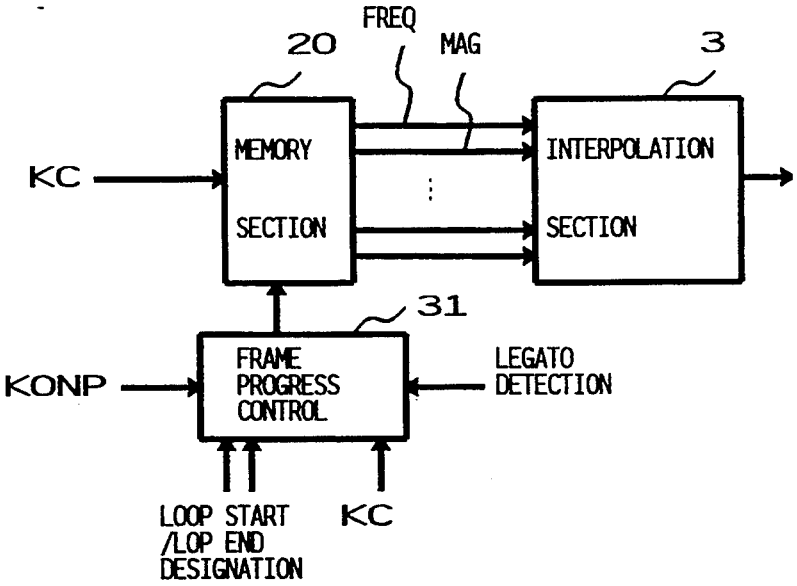
FIG. 17 is a block diagram illustrating another example of detailed arrangements employed in a part associated with the memory section of FIG. 1.
Figure 18:
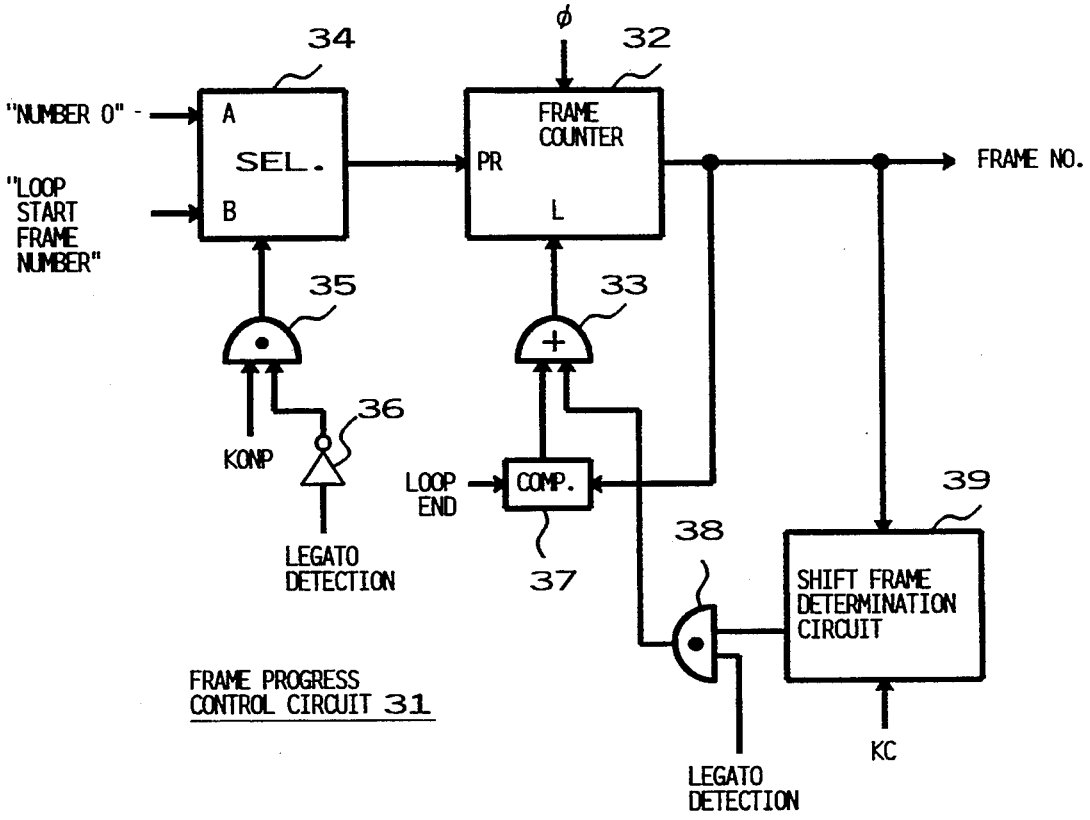
FIG. 18 is a block diagram illustrating a detailed example of the frame progress control circuit of FIG. 17.

FIG. 17 shows an embodiment in which voice data itself is changed to effect legato. Namely, in this embodiment, arrangements are made such that, when pitch is shifted for legato, voice data to be read out is changed, with its frame number being left unchanged. Also, this embodiment is directed to realizing a looped readout control by supplying a loop-start frame number and a loop-end frame number. To a memory section 20 is connected a frame progress control circuit 31 an example of which structure is shown in FIG. 18. A frame counter 32 provides frame number signal to the memory section 20, which in turn outputs frame data in accordance with the frame number signal. The frame counter 32 is counted up by count signal $\phi$ whose frequency is one-sixty fourth of the frequency of the sampling clock pulses. Load signal input terminal of this frame counter 32 is connected with an OR circuit 33, while preset data input terminal of the counter 32 is connected with a selector 34. Leading frame number ("0") of voice data is provided to "A" input terminal of the selector 34, and loop-start frame number is provided to "B" input terminal of the selector 34. Further, select signal input terminal of the selector 34 is connected with an AND circuit 35, so that the selector 34 selects the A input when the AND circuit 35 outputs a logical "1" and selects the B input when the AND circuit 35 outputs a logical "0". To the AND circuit 35 are provided key-on pulse KONP and legato detection signal as inverted by an invertor 36. As mentioned earlier, the legato detection signal is output, for example, when shift of keys activated on a keyboard is performed in an overlapping manner, or when a key operation is switched during a press-on state in a wind instrument type controller. Because of the above-said connection, the selector 34 prov ides the data (leading frame number "0") on the A input to the preset data input terminal of the frame counter 32 only when no legato is detected at a key-on time. Otherwise, the selector 34 provides the data (loop-start frame number) on the B input to the preset data input terminal of the frame counter 32.

A comparator 37 and an AND circuit 38 are coupled to the OR circuit 33 connected with the load signal input terminal of the frame counter 32. The comparator 37 compares the frame number output from the frame counter 32 with the loop-end frame number, and it outputs a logical "1" when the frame number and loop-end frame number coincide with each other. Further, to the AND circuit 38 are provided legato detection signal and signal output from a shift frame determination circuit 39. When pitch (voice data) is changed, the shift frame determination circuit 39 determines presence in new voice data of any frame that is identical in frame number to a frame number being currently read out. If there is no such frame, the shift frame determination circuit 39 outputs a logical "1". Accordingly, if there is no frame corresponding to the new voice data when legato has been detected, the determination circuit 39 outputs a preset signal to preset a loop-start frame. If, on the other hand, there is a frame that is identical in frame number to the frame number being currently read out, the determination circuit 39 does not output a logical "1", so that no load signal is generated and thus the frame counter 32 keeps on counting without being influenced by change in voice data.

Figure 19:
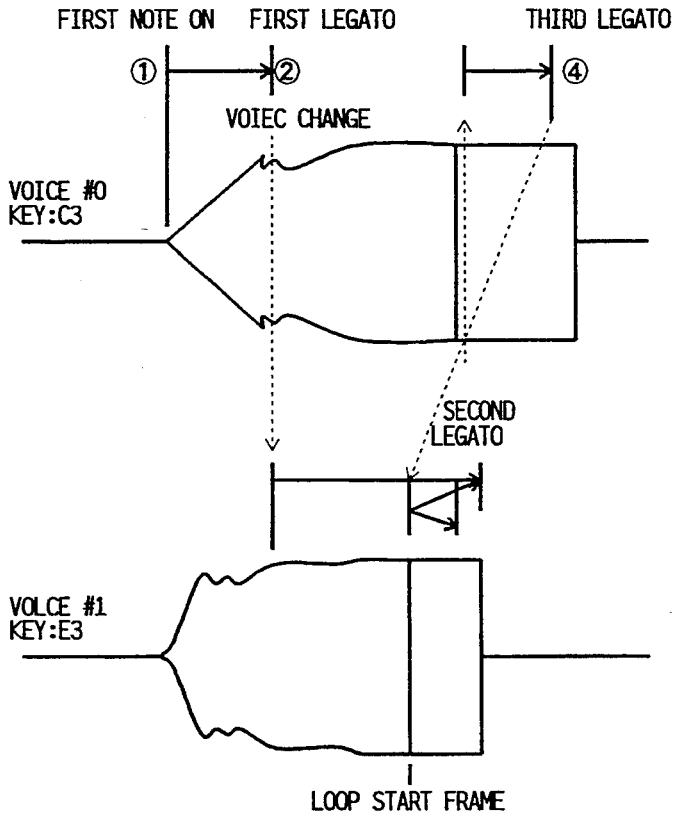
FIG. 19 graphically represents an example of control operations carried out in response to a legato performance action, with a view to explaining operations of the arrangements shown in FIG. 18.
Figure 20:
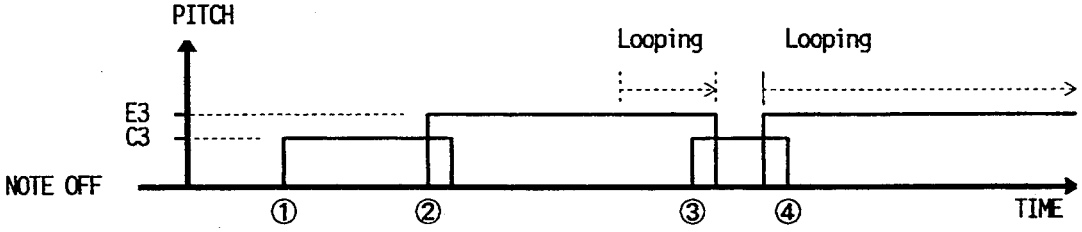
FIG. 20 is a timing chart explanatory of the operations represented in FIG. 19.

Because of such an arrangement of the frame progress control circuit 31, legato process is carried out in the manner as shown in FIGS. 19 and 20, in which it is seen that pitch is shifted in legato in the sequence of ①C3→②E3→③C3→④E3. Because the first legato ①C3→②E3 is still at the attack portion of a tone and thus a corresponding frame is present, shift is made to a frame of the same frame number. Subsequently, loop is directly made because tone generation of E3 lasts beyond the data length, but the same shift is made in the second legato ②E3→③C3 because a frame of the identical number is present. Further, in the third legato ③C3→4 E3, shift is made to the loop-start frame of E3 because no frame of the identical frame number is present at the E3 side.

The embodiment of FIG. 17 has been described as having voice data for each tone color. However, when one voice data is shared among plural keys and legato is to be effected across a same keyboard region (region in which a same voice data is utilized), such legato can be achieved by shifting frequency data of the voice data in the manner as shown in FIG. 14.

In effecting legato, more effective legato is attained by providing a smooth shift to a destination frame through interpolation operations.

Figure 21:
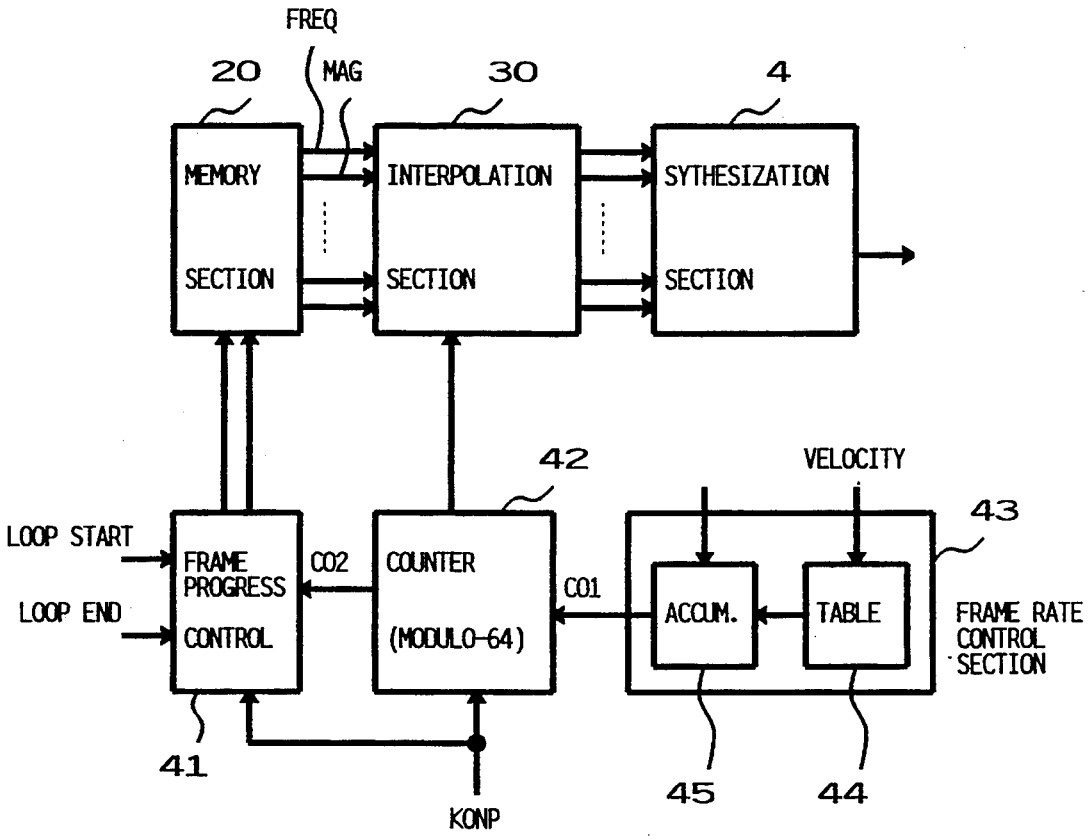
FIG. 21 is a block diagram illustrating an example of detailed arrangements for readout from the memory section of FIG. 1.
Figure 22:
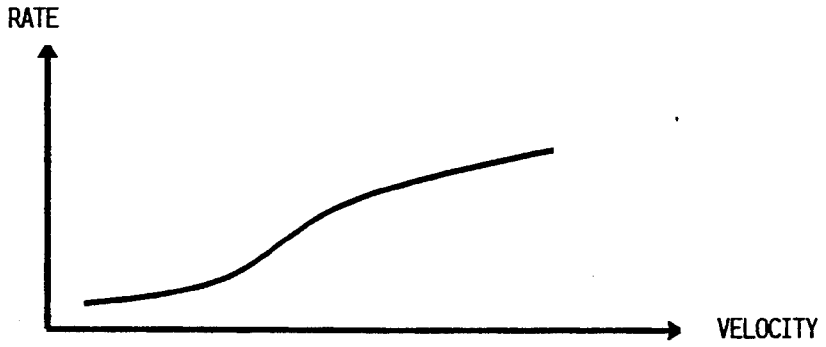
FIG. 22 is a graph illustrating an example of data conversion characteristics of the velocity data conversion table shown in FIG. 21.

FIG. 21 shows another embodiment which is directed to performing controls in accordance with velocity data that is supplied in correspondence to the intensity of a performance operation. A memory section 20 is connected with a frame progress control section 41, and an interpolation section 30 is connected with a counter 42 which is in turn connected with a frame rate control sect ion 43. The frame rate control section 43 is composed of a table 44 and an accumulator 45. The table 44 is a memory storing a velocity/speed table as shown in FIG. 22 and outputs rate data on the basis of velocity data that is input from a performance device such as a wind instrument type controller. The rate data is given to an accumulator 45, which adds up the rate data in a repeated manner in accordance with clock pulse signals. The accumulator 45 outputs carry-out signal CO1 to the counter 42. Because of the stored content as shown in FIG. 22, the table 44 outputs greater rate data in response to greater velocity data.

Consequently, as the velocity data becomes greater, the accumulator 45 is counted up at a higher rate, and so the carry-out signal CO1 is output from the accumulator 45 at shorter intervals. The carry-out signal CO1 is provided to the count terminal of the counter 42, which in turn outputs its count to the interpolation section 30 and also outputs its carry out signal CO2 to the frame progress control section 41. Because the counter 42 is a modulo-64 counter, a carry-out signal CO2 is generated and one frame progress occurs every 64 counts of the counter 42. Key-on pulse is input to the reset terminal of the counter 42 and to the frame progress control section 41. Loop-start frame number and loop-end frame number are also fed to the frame progress control section 41. With such an arrangement, at key-on time, tone synthesis is initiated from frame 0. Then, when the tone synthesis lasts for a long time, it is continued by repeatedly reading data between the loop-start frame and loop-end frame.

Figure 23:
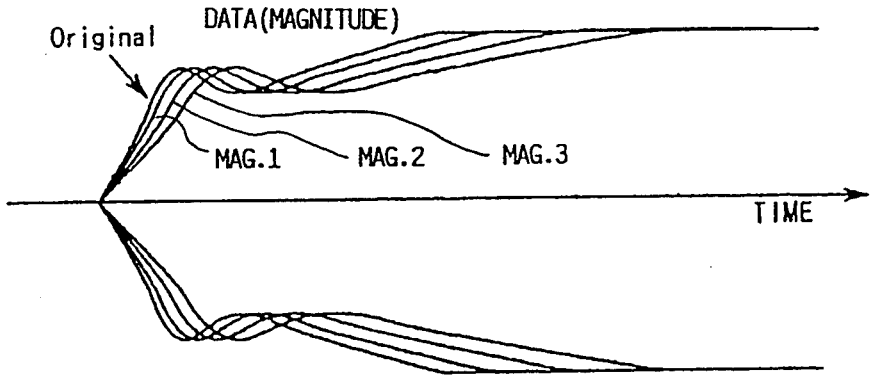
FIG. 23 is a diagram explanatory of the operations of the arrangements shown in FIG. 21, and schematically showing that tone waveform change rate is varied in accordance with the magnitude of velocity data.

In this embodiment, because a value set in the accumulator 45 becomes greater (or smaller) as the velocity data becomes greater (or smaller), interval between carry-out signals CO1 becomes shorter (or longer, and so interpolation interval and frame read-out interval both become shorter (or longer). This allows tone color change rate or speed to be varied in correspondence to the velocity. Also in this case, control is made of the interval at which the analyzation parameters (frequency data, tone volume data) are read out, and so frequency of a synthesized tone will not undesirably be changed by the control. FIG. 23 is a schematic representation a tone waveform envelope and exemplifies that frame switch interval of an original tone waveform gets longer as the magnitude of velocity data becomes greater.

Accordingly, the embodiment of FIGS. 21 to 23 allows tone color change rate to be varied on the basis of the performance action intensity (velocity).

Figure 24:
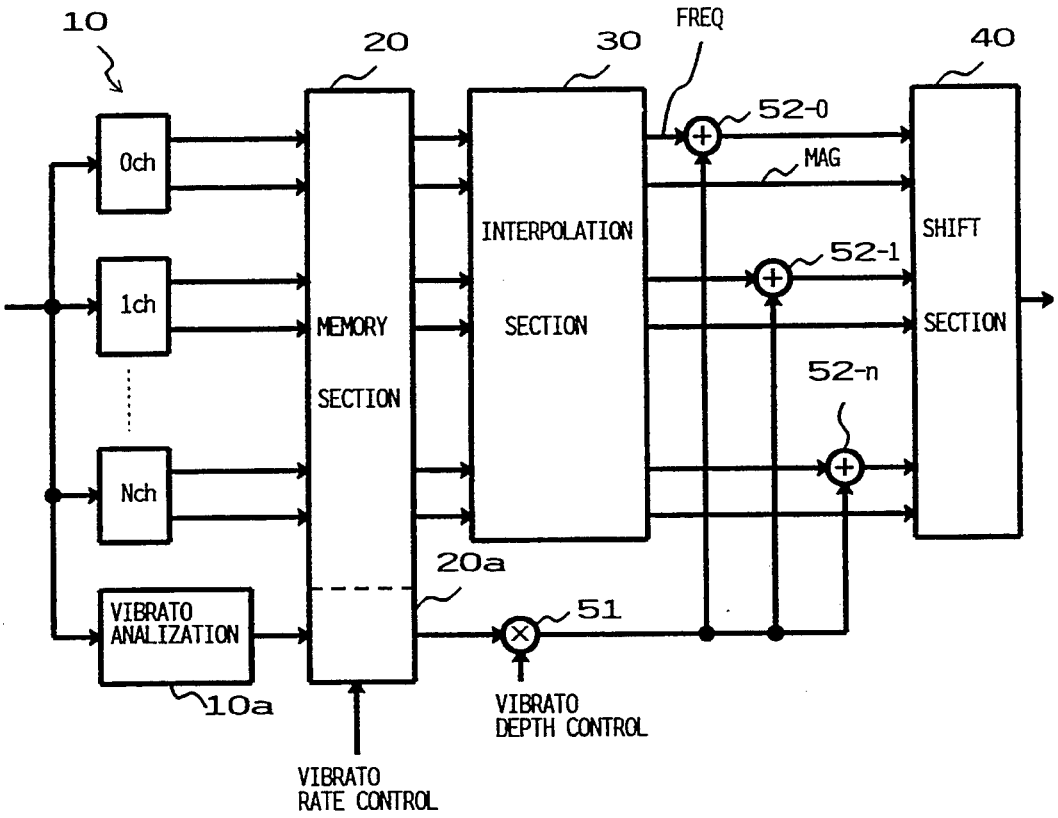
FIG. 24 is a block diagram illustrating an example of detailed arrangements in which a vibrato control device is incorporated in connection with the memory section of FIG. 1.
Figure 25:
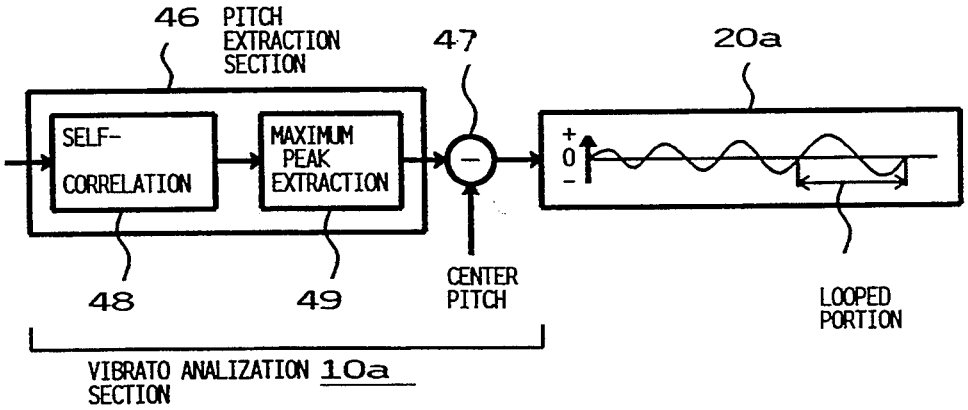
FIG. 25 is a block diagram illustrating a detailed example of the vibrato control device of FIG. 24.

FIG. 24 shows another example which is capable of performing vibrato controls. In this embodiment, an analyzation section 10 analyzes not only a spectrum (local peaks) for each of separate n channels (128 channels) but also an overall vibrato waveform. A memory section 20 stores, for each voice data, vibrato data in addition to frame data as shown in FIG. 4. Vibrato waveform data are stored in a vibrato waveform data storage area 20*a* of the memory section 20. Further, FIG. 25 shows example structures of a vibrato analyzation portion 10*a* of the analyzation section 10 and of the vibrato waveform data storage area 20*a* of the memory section 20. The vibrato analyzation portion 10*a* is composed of a pitch extraction portion 46 and a subtracter 47. The pitch extraction portion 46 includes a self-correlation circuit 48 and a maximum peak extraction circuit 49. The self-correlation circuit 48 is a circuit that extracts a frequency change out of the latest frequency, and the maximum peak extraction circuit 49 is a circuit that extracts local peaks in the extracted frequency change. Thus, by subtracting the center pitch of this tone waveform data from the extracted frequency change value, a vibrato waveform can be extracted. The center pitch subtraction is done by the subtracter 47. The vibrato waveform thus extracted is then stored as pitch change data into the vibrato waveform data storage area 20*a* in time series. Voice data which has thus been stored into the memory sect ion 20 are read out when resynthesization of tone waveform is carried out. Frame data are read out in accordance with frame number data provided from a frame counter (not shown), and the vibrato waveform data are read out in accordance with vibrato rate control data. The read-out frame data are input to an interpolation section 30. The interpolation section 30 performs a linear interpolation between the preceding and succeeding frame data in response to each sampling clock pulse and outputs the interpolated data. The vibrato waveform data are read out from the memory section 20 in response to each sampling clock pulse and then provided to a multiplier 51 in which they are multiplied by vibrato depth control data. The vibrato depth control data are generated on the basis of after-touch data or modulation wheel data that are provided from a performance device such as a keyboard. The vibrato waveform data that have been multiplied with the vibrato depth control data are input to adders 51-0 to 51-n which are provided, one for each channel, between the interpolation section 30 and a shift section 4. To the adders 51-0 to 51-n are also input interpolated frequency data FREQ of the respective channels. The frequency data FREQ are added by the adders 51-0 to 51-n with the vibrato waveform data (frequency addition data) and then are given to the shift section 4. Thus, only vibrato contents of sampled tone waveform are separately stored, so that, at the resynthesization time, they are added after having been adjusted in depth and rate.

It should be understood that the vibrato waveform data may alternatively be multiplied with the frequency data FREQ. Further, the vibrato waveform data may be reduced in value so as to perform controls for subduing vibrato effect. Moreover, the vibrato waveform data may be read out at a suitable in-phase portion in a looped (repeated) manner.

As described above, in the embodiment of FIGS. 24 to 25, only vibrato waveform is extracted and stored so that vibrato depth/rate can be freely adjusted. Further, because vibrato waveform is read out in a looped (repeated) manner separately from the looped read-out control of tone waveform, optimum vibrato can be effected, and there is no possibility of vibrato phase shift being caused even when tone waveform is read-out in a looped manner.

Figure 26:
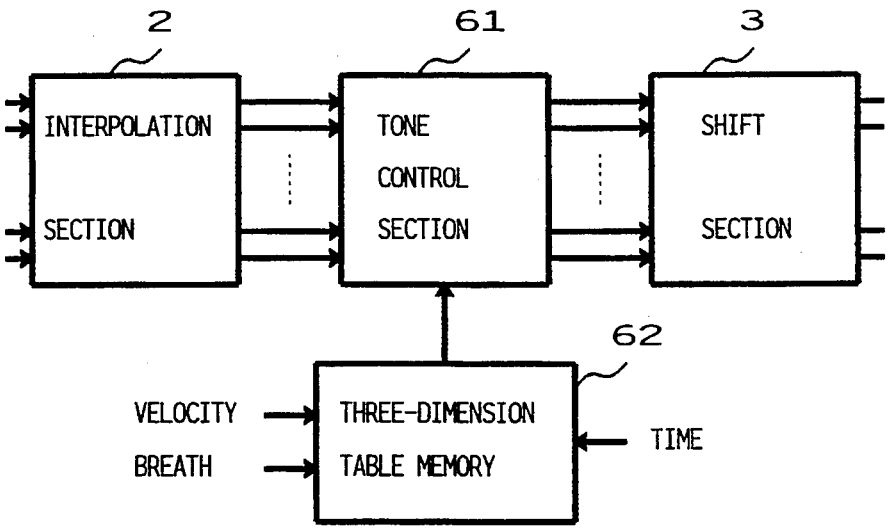
FIG. 26 is a block diagram illustrating another embodiment of the invention in which a tone control section is incorporated between the interpolation section and the shift section shown in FIG. 1.

FIG. 26 is a block diagram showing a partial structure of still another embodiment of the invention. This embodiment is directed to controlling analyzation data (frequency data FREQ, magnitude data MAG etc.), using performance operation simulating data such as note-on velocity data or breath data, or tone generation duration data. In this analyzation/synthesization tone source device, a tone control section 61 is disposed between an interpolation section 3 and a shift section 4, and a three-dimension-table memory 62 is connected to the tone control section 61 and stores three three-dimension-tables (shown in FIG. 27 as tables TB1, TB2 and TB3). The table TB2 is the one that is used to obtain parameter for controlling magnitude data MAG (magnitude control amount) on the basis of channel number and note-on velocity data. The table TB3 is the one that is used to obtain magnitude control amount on the basis of channel number and breath data. Further, the table TB1 is the one that is used to obtain contribution degree of the magnitude control amount on the basis of channel number and frame number (tone generation duration data). Graphic representation of the respective stored contents in the tables TB1, TB2 and TB3 are given in FIGS. 28 and FIG. 28 is a graphic representation of the stored contents in the table TB1 that is used to obtain a change in contribution degree of the magnitude control amount read out from the table TB2, which change depends upon the channel number and frame number. As shown, this table TB2 is established in such a manner that no time-varying decay is given to higher band area components (greater channel numbers), influence of the note-on velocity data remains even in the steady state (greater frame numbers), and time(frame number)-varying decay amount becomes greater in lower band areas (smaller channel numbers). This table, as mentioned earlier, is for obtaining contribution degree of the magnitude control amount obtained from the table TB2, by carrying out an arithmetic operation of 1—(contents of the table TB1) in an operation section 69. Accordingly, it is assumed here in this embodiment that the note-on velocity data mainly governs tone color of the attack portion of a tone while the breath data governs tonal quality of the steady port ion of a tone. This table provides corresponding value to each channel in accordance with input frame clock pulses.

Figure 29:
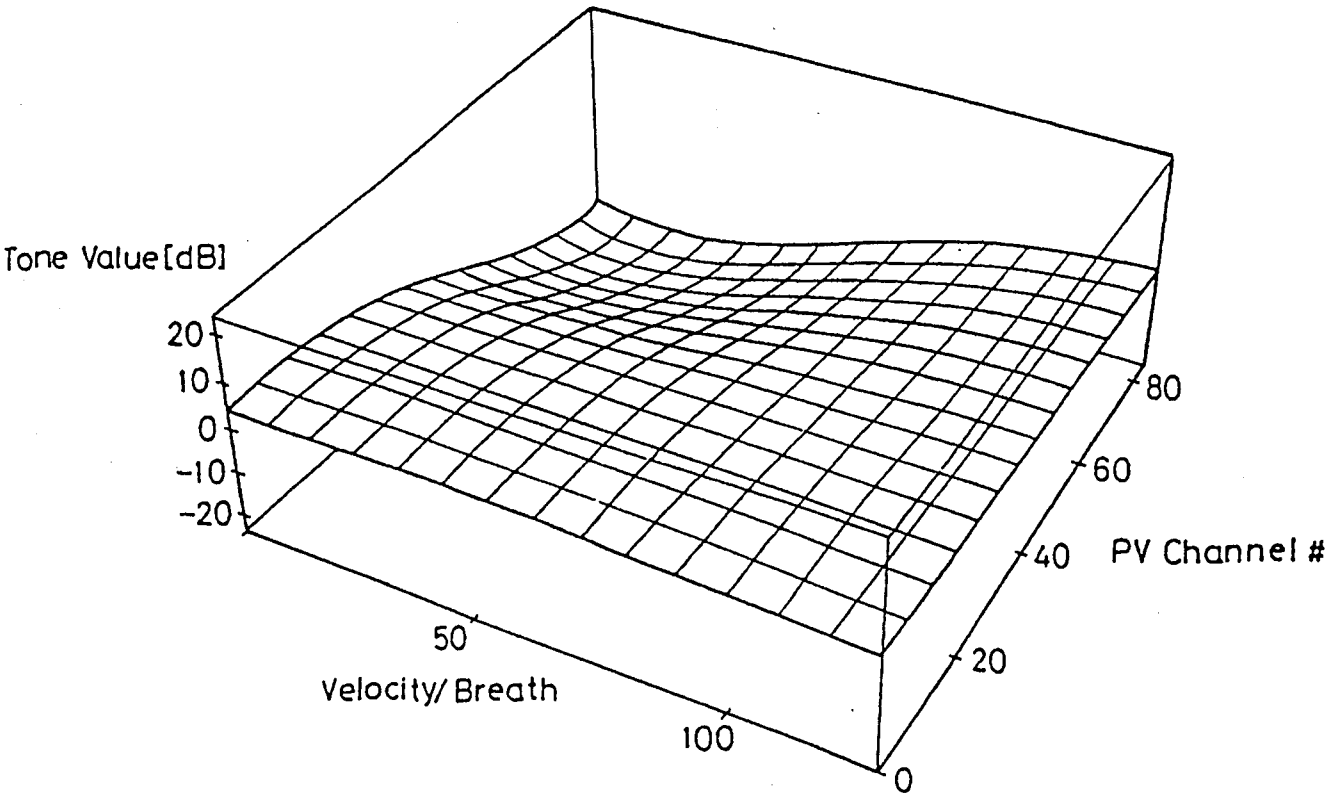
FIG. 29 is a graphic representation of example stored contents of another table contained in the three-dimension table memory.

FIG. 29 is a graphic representation of the stored contents in the tables TB2 and TB3. In this embodiment, the tables TB2 and TB3 employ a same function. These tables are established in such a manner that the higher band area components are made smaller as the velocity data or breath data becomes lower, while the higher band area components are made greater as the velocity data or breath data becomes higher. These tables provide corresponding value to each channel in accordance with input key-on velocity data and Breath data. It should be noted that, although these tables as shown here have been prepared in a mathematical fashion on the basis of a common "control image", they also can be prepared by making actual strong/weak performances and carrying out interpolations of the spectrum envelopes.

Figure 27:
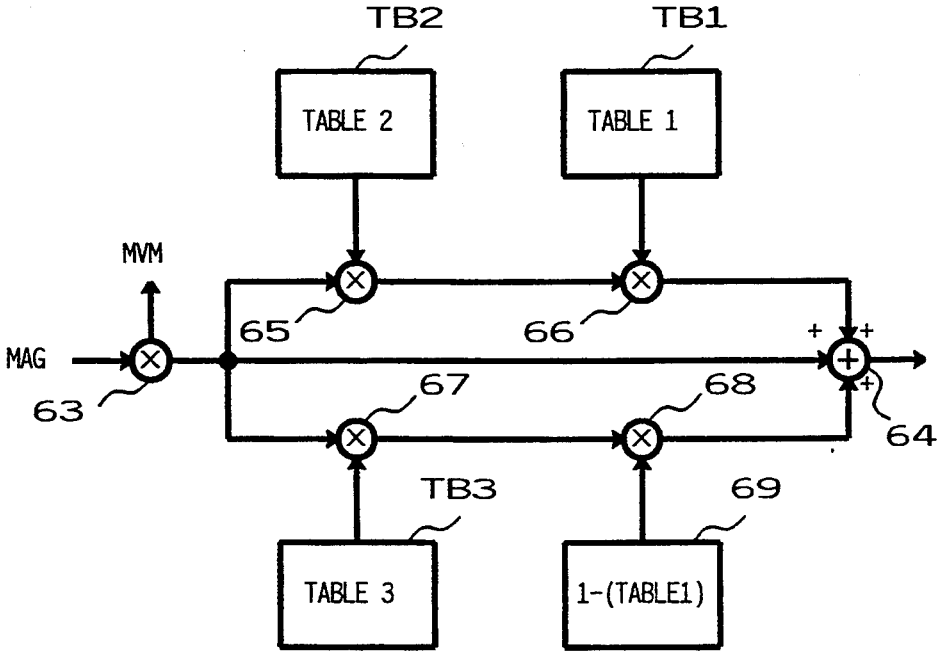
FIG. 27 is a block diagram illustrating an example of detailed structure of the tone control section of FIG. 26, the structure being shown in connection with only one of plural channels for simplicity.
Figure 28:
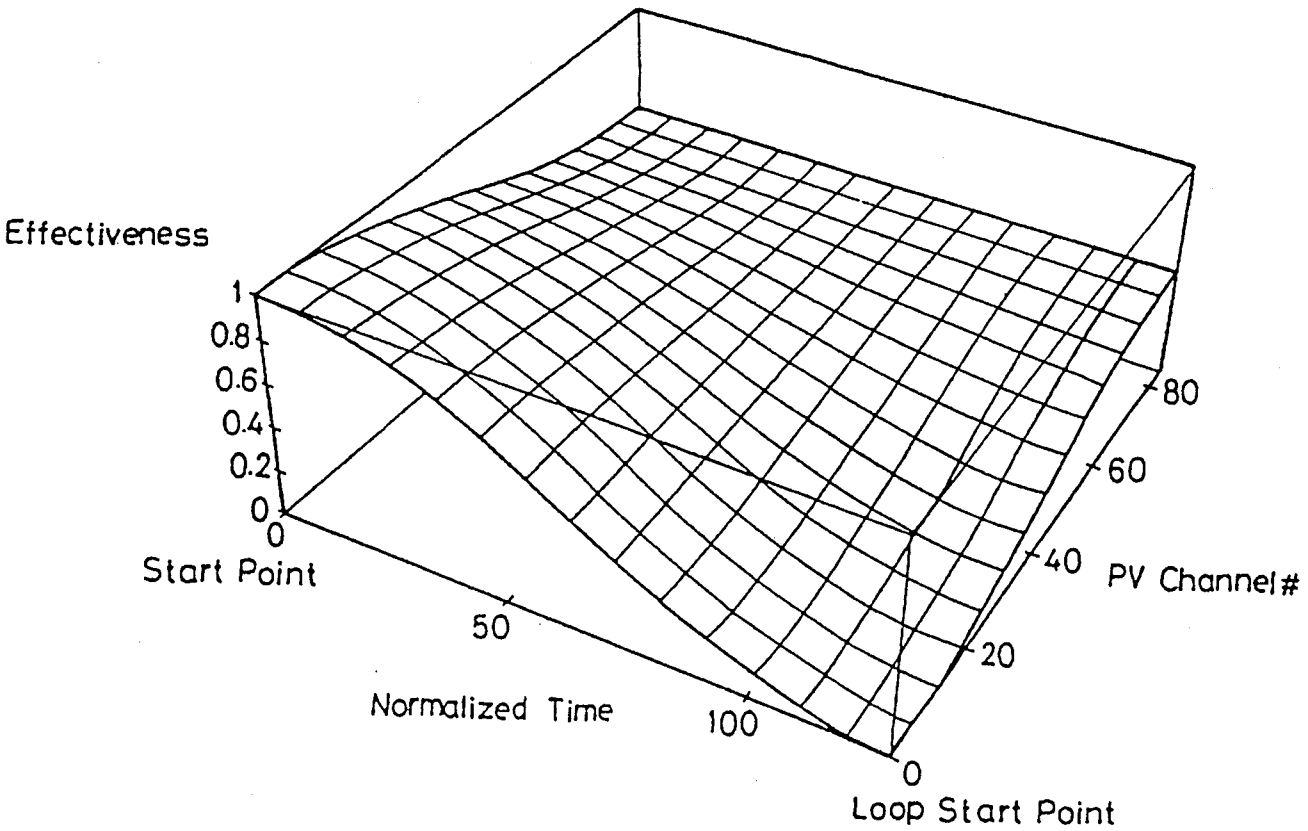
FIG. 28 is a graphic representation of example stored contents of a specific table contained in the three-dimension table memory shown in FIG. 26.

Referring back to FIGS. 26, the tone control section 61 includes, for each channel, circuitry shown in FIG. 27 for controlling the magnitude data MAG of the corresponding channel. A multiplier 63 is disposed at the input side, and an adder 64 is disposed at the output side. To the multiplier 63 is input main volume data MVM. Three transmission paths extend between the multiplier 63 and the adder 64. One of the transmission paths provides a direct connection between the two components 63 and 64, another transmission path connects the components 63 and 64 via multipliers 65, 66, and the other transmission path connects the components 63 and 64 via multipliers 67, 68. The multiplier 65 receives the magnitude control amount read out from the table TB2, and the multiplier 66 receives the contribution degree read out from the table TB1. Thus, the transmission path incorporating these multipliers 65, 66 takes part in adjustment of the magnitude data MAG to be done by the note-on velocity data. The multiplier 67 receives the magnitude control amount read out from the table TB3, and the multiplier 68 receives a complement of the contribution degree read out from the table TB1. Thus, the transmission path incorporating these multipliers 67, 68 takes part in adjustment of the magnitude data MAG to be done by the breath data. The contribution degree takes a value ranging from 0 to 1 and so its complement also takes a value ranging from 0 to 1. The multiplier 64 adds up these values to provide a tone-controlled output. Namely, because both the magnitude control amount and the contribution degree take different values from one channel to another, analyzation parameter having passed through the tone control section 61 will have spectrum envelopes of different shapes.

Although it has been described above that only magnitude data MAG of the analyzation parameter is control led, frequency data FREQ or both of the magnitude data MAG and frequency data FREQ may be controlled in this embodiment.

Further, although it is assumed here that a wind instrument type controller is used as a performance controller to be connected to the tone source device according to the embodiment of FIG. 26, other controllers may be used such as a keyboard capable of outputting after-touch data.

As has been described above, with the embodiment of FIGS. 26 to 29, it is made possible to achieve delicate tone color adjustments because frequency data and magnitude data can be adjusted for each spectrum.

Figure 30:
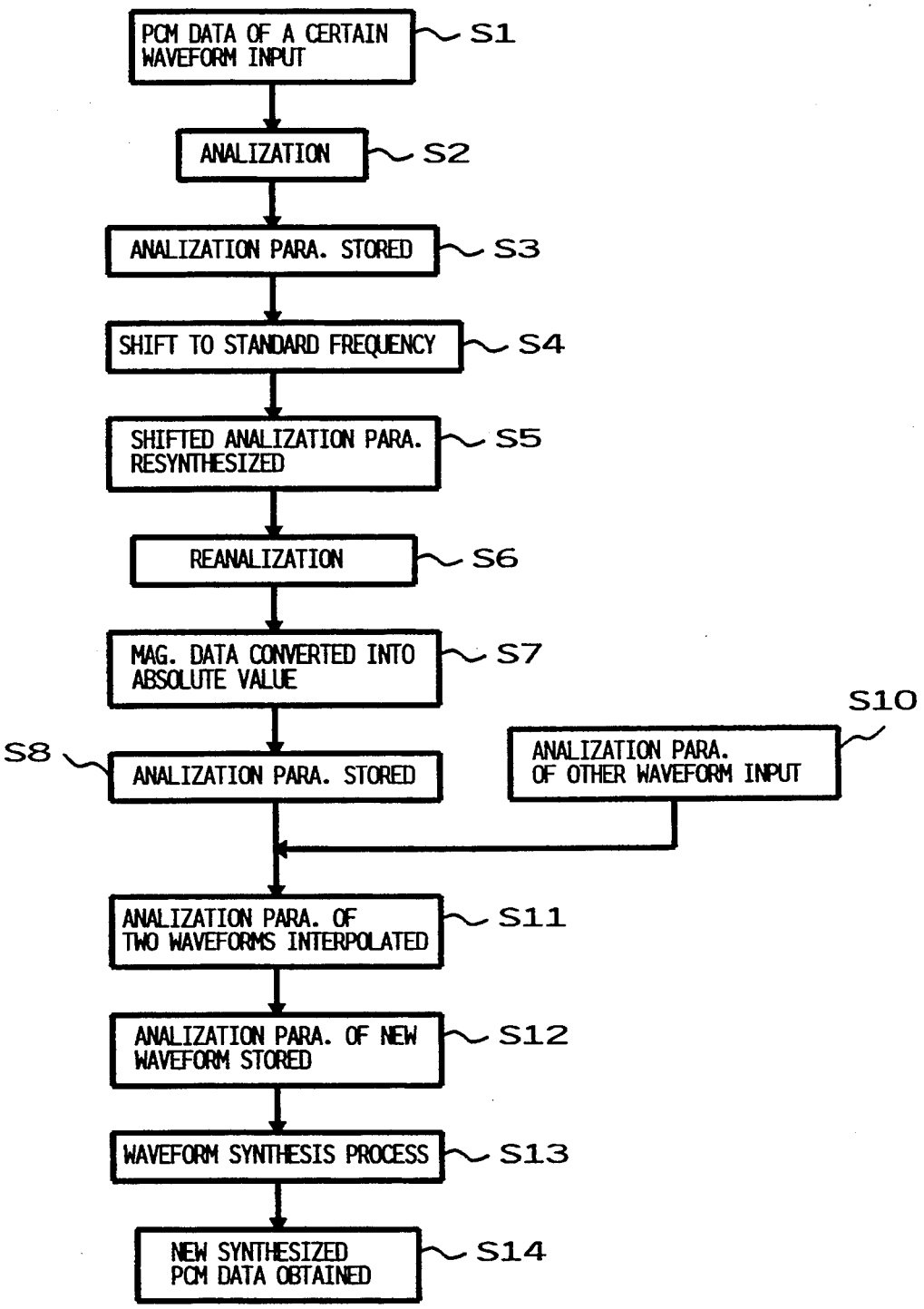
FIG. 30 is a flow chart showing another embodiment of analyzation process cart led out using the tone source device of FIG. 1.
Figure 31A:
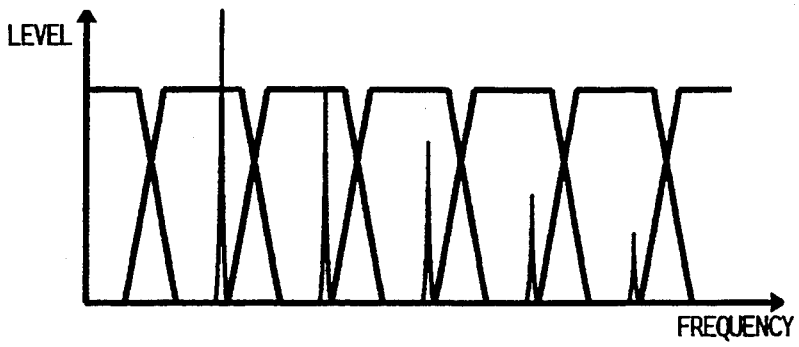
FIGS. 31A to 31D are diagrams illustrating example spectrum data processed in accordance with the embodiment of FIG. 30.
Figure 31B:
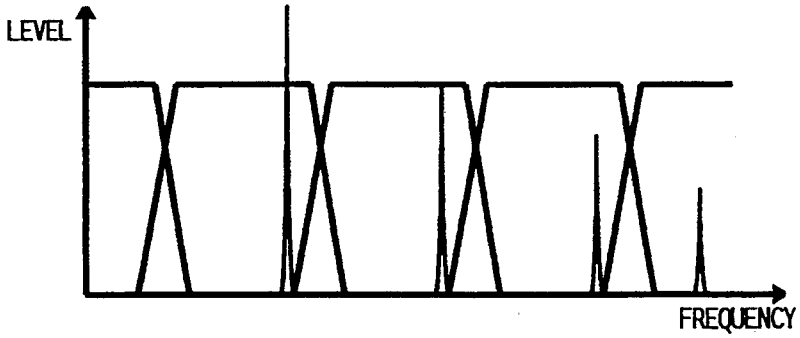
Figure 31C:
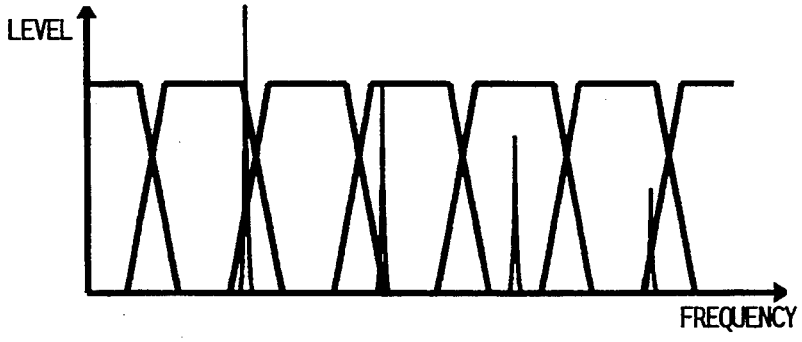
Figure 31D:
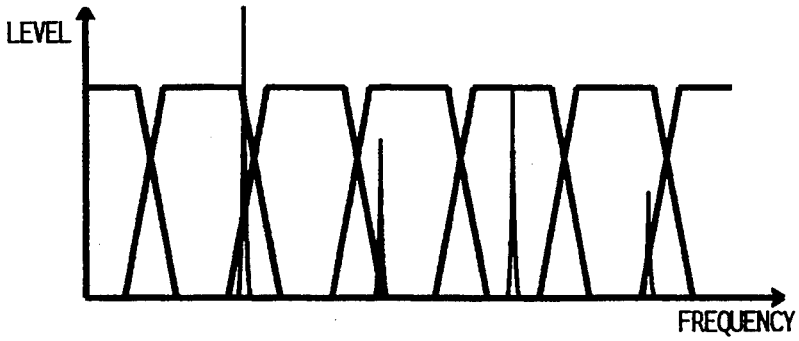

FIG. 30 is explanatory of another embodiment of tone waveform data analyzation/synthesization procedures that are carried out in the tone source device constructed as shown in FIG. 1, and FIGS. 31A to 31D show example spectra obtained by the procedures shown FIG. 30. In the procedure of FIG. 30, steps S1 to S5 are preliminary processes for generating PCM data to be input to the analyzation section 1, in which analyzation parameters to be stored into memory section 2 are extracted in the manner previously mentioned. Namely, in step S1, original PCM data (FIG. 31A) is input to the analyzation section 1. The original PCM data contains a fundamental wave and harmonic components or formant component (overtone spectrum) which fall within the filter band of any of the BPFs, so that the PCM data is formed into 128-channel analyzation parameters to be output at an interval of 64 samples (steps 2 and 3). The data at this stage can not be interpolated with other tone waveform data that has been formed into analyzation parameter at a standard frequency(FIG. 31D). Because, interpolation between the analyzation parameters is performed on parameters of a same channel, and thus channel number remains unchanged even if the analyzation parameter is shifted as shown in FIG. 31B. It should now be noted that the term "interpolation" used here means an interpolation between different waveforms and must be interpreted as being distinguished from the previously described interpolation between different frames.

Then, in step 4, the original frequency data of each spectrum is shifted in the shift section 4 in accordance with a ratio of its fundamental frequency relative to the predetermined standard frequency as shown in FIG. 31B. In next step 5, the shifted analyzation parameter is resynthesized by the synthesization section 5 into tone waveform data, which is reinput to the analyzation section 1 so as to be formed into another analyzation parameter (step 6). In this way, the analyzation parameter assumes characteristics as shown in FIG. 31*c* because it is of the standard frequency, and thus the analyzation parameter can be interpolated with the other tone waveform data analyzed and stored at the standard frequency to generate a new voice. But, the magnitude may take negative values depending on the conditions of the sampling or the shift. The positive or negative of the magnitude value varies from one analyzation parameter to another, and so, if analyzation parameters of plural kinds of waveforms are directly interpolated with each other, their components are likely to cancel each other, resulting in undesirably thin tone or unwanted noise. To avoid such problems, all the magnitude data are converted into absolute values (step 7), and the thus converted analyzation parameters are stored into the memory section 2. These analyzat ion parameters and analyzation parameters of the other tone waveform (FIG. 31D) are different from each other in terms of magnitude of each spectrum but are same in terms of the spectrum distribution. Accordingly, by interpolating the parameters of the two waveform channel by channel (step 11), it is allowed to form analyzation parameter of a new tone waveform (step 12). Also, by performing waveform data processing on the basis of the new analyzat ion parameter (step 13), PCM data of the new tone waveform can be obtained (step 14). It is to be understood that, in order to obtain tone waveform data of any desired frequency, it is only sufficient that the interpolated parameter is shifted by the shift section to a predetermined frequency and then resynthesized. The preferred arrangements may be that the analyzation parameter of the new tone waveform obtained in step 12 is stored into the memory section 2 and then the waveform synthesization process of step 13 is performed by reading out the stored contents. Alternatively, the analyzation parameter obtained in step 12 is directly input to the synthesization section 5 so as to perform the waveform synthesizat ion process of step 13.

As has been described above, with the embodiment of FIGS. 30 and 31, it is made possible to achieve intermediate tone colors as desired by data interpolation between different waveforms, thereby improving musical expression.

Figure 32:
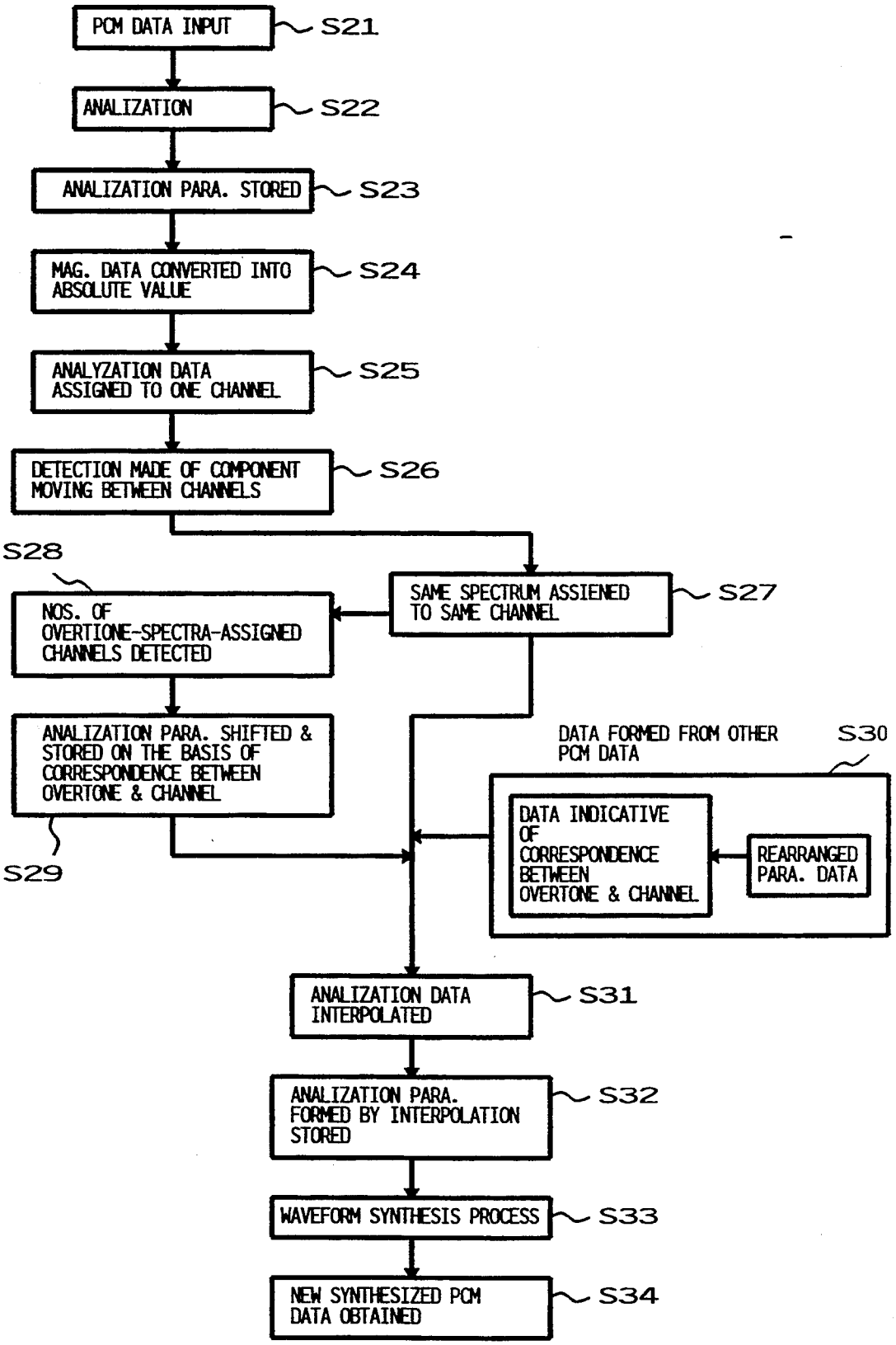
FIG. 32 is a flow chart showing still another embodiment of analyzation process carried out using the tone source device of FIG. 1.
Figure 33A:
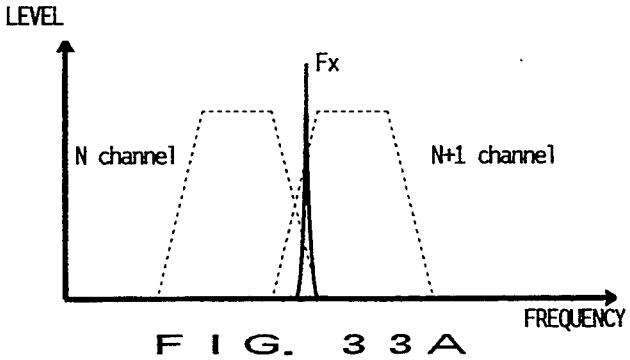
FIGS. 33A to 33E are diagrams showing, with respect only to a single line spectrum, an example process performed in accordance with the embodiment of FIG. 32.
Figure 33B:
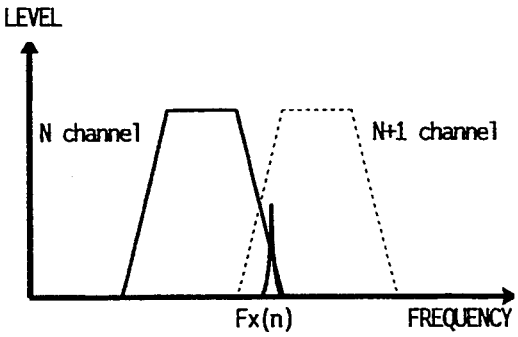
Figure 33C:
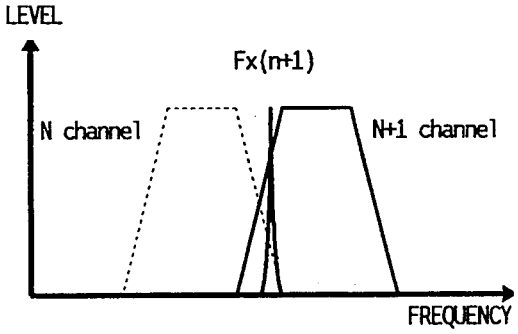
Figure 33D:
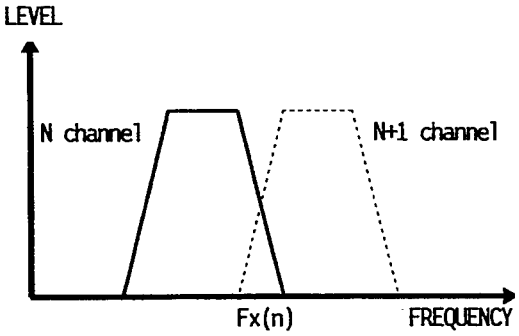
Figure 33E:
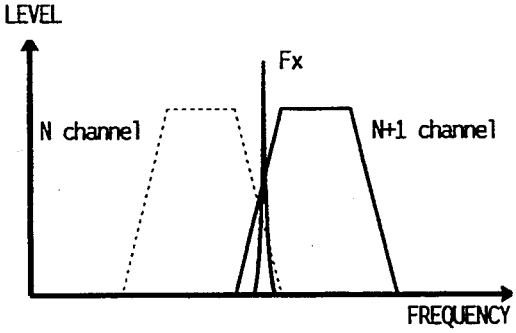

FIG. 32 is a flow chart illustrating an alternative embodiment of process performed by the analyzation section 1, and FIGS. 33A to 35D together are explanatory of the manner in which data assignment is carried out in the embodiment. Referring first to FIG. 32, original PCM data is input to the analyzation section 1 in initial step 21, in which sect ion the data is processed to form an analyzation parameter composed of frequency data and magnitude data (steps 22), and then the analyzation parameter is stored into the memory section 2. Because the positive or negative of the original PCM data usually differ due to the sampling conditions, the magnitude data of the analyzation parameter is converted into an absolute value (step 24). Further, in this state, the original PCM data contains a fundamental wave and plural overtone spectra each of which falls within the filter band of any of the BPFs. Also, each of the spectra is distributed across two channels in partly overlapped relation.

FIG. 33 A illustrates an example of such spectrum, in which Fx represents an original spectrum. In each of FIGS. 33A to 33E and 34A, there are shown, by way of example, respective pass bands of "N channel" and "N+1 channel". This original spectrum Fx causes analyzation parameters for both of the channels N, N+1 channel, Fx(n) in FIG. 33B represents a component of spectrum Fx generated through analyzation of the channel N, and Fx(n +1) in FIG. 33C represents a component of spectrum Fx generated through analyzation of the channel N+1. When analyzation data of the same frequency component Fx are thus generated at different channels in this manner complex arithmetic operations will be needed for subsequent interpolation. So in this embodiment, process for assigning or allocating the generated analyzation data to either of the channels is carried out in step 25. The assignment is made to one channel at which the magnitude is greater than that at the other channel. That is, the magnitude data of the analyzation parameter at one channel (N) having the smaller magnitude is added to the magnitude data at the other channel (N+1) having the greater magnitude, in such a manner that component substantially similar to the original spectrum Fx becomes the analyzation data for the channel (N+1) (as shown in FIG. 33E) and Fx component of the channel (N) becomes zero.

Figure 34A:
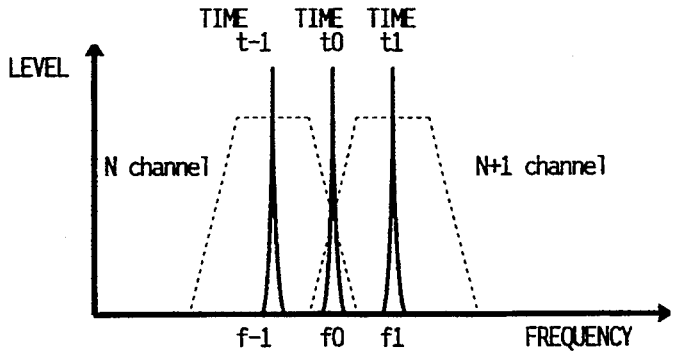
FIG. 34A to 34E is a graph explanatory of another example of process performed in accordance with the embodiment of FIG. 32, and FIGS. 35A to 35D are schematic diagrams explanatory of the process performed in accordance with the embodiment of FIG. 32.
Figure 34B:
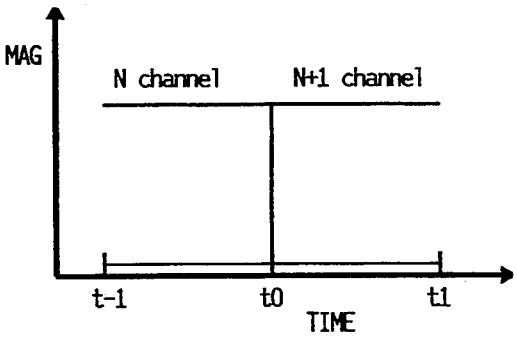
Figure 34C:
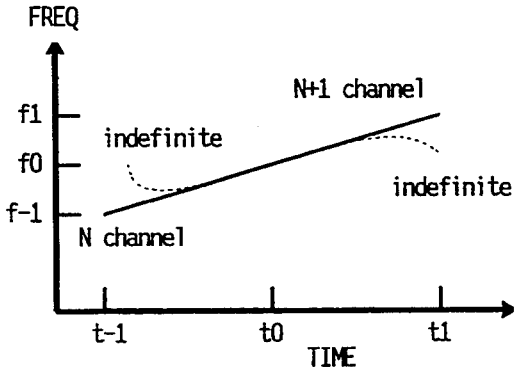
Figure 34D:
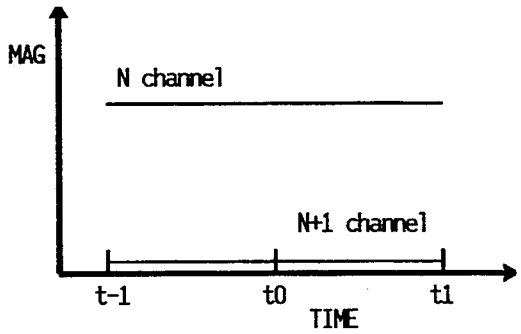
Figure 34E:
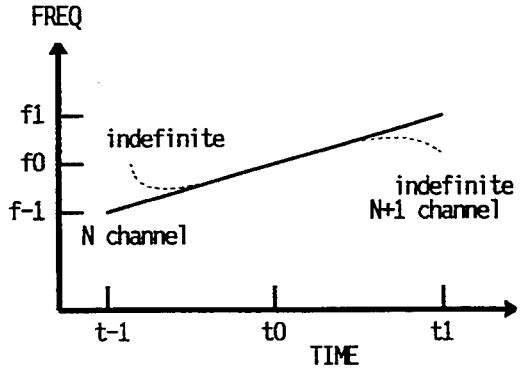
Figure 35A:
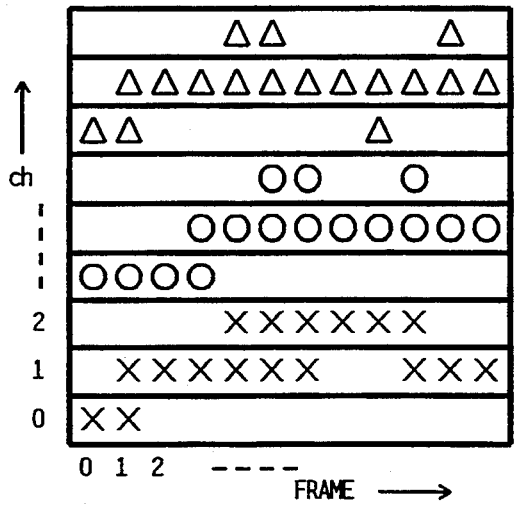
Figure 35B:
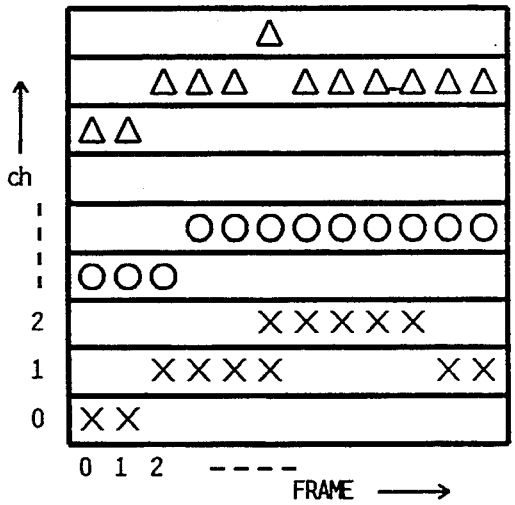

FIG. 35A represents an example of the analyzation data for each channel before the assignment process, and FIG. 35B represents the analyzation data for each channel after the assignment process. Subsequently, detection is made of component moving between channels (step 26). For example, assuming that frequency of one spectrum, as shown in FIG. 34A, sequentially moves through frequencies f-1, f0 and f1 at respective time points t-1, t0 and t1, the same frequency data FREQ is detected at both channels N, N+1 before and after time point t0 as shown in FIG. 34C. On the other hand, because of the assignment process of step 25, the magnitude data of channels, as shown in FIG. 35B, abruptly change in the neighborhood of time point t0. When the detected states of the frequency data FREQ and the magnitude data MAG conform to the above-mentioned conditions, it is determined that a spectrum shift has occurred present. On the basis of this detection, the same spectrum is assigned to the same channel (step 27), because it is preferable that the same spectrum be processed at the same channel even when there occurs some fluctuation in tone pitch at the attack portion or the like. That is, when it has been found, through the analysis of frame data corresponding to time point t1, that the spectrum has moved to channel N+1, the BPF filter band of channel N is exchanged with that of the BPF filter band of channel N+1 and then the frame data corresponding to time point t1 is reanalyzed. Thus, in the reanalyzation process, the frame data corresponding to time point t1 is caused to pass through channel N, with the result that data of the same spectrum is caused to be analyzed at the same channel N.

Figure 35C:
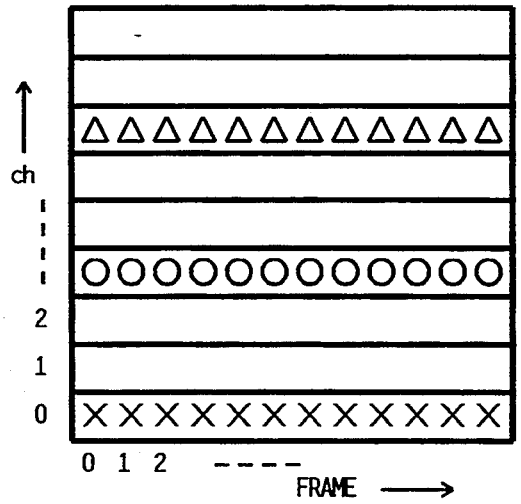
Figure 35D:
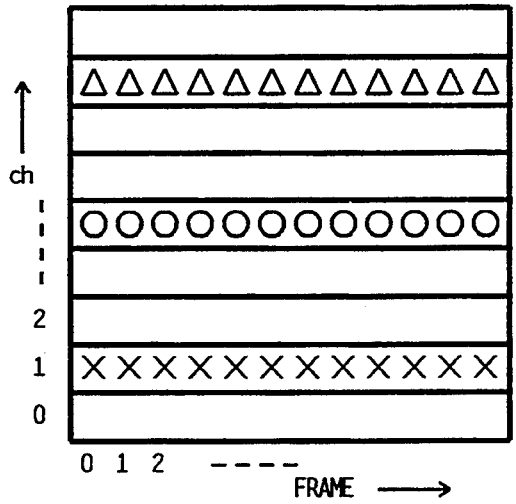

Thereafter, on the basis of the frequency of the fundamental tone, detection is made of channel numbers to which the overtone spectra should have been assigned. These channel numbers to be detected are the ones to which the overtones belong when the tone waveform data is in the steady state. In the event that the analyzation parameters of each overtone spectrum being stored are not in the correct detected channels, then are shifted they to the correct detected channels so that the correct analyzation parameters are stored into memory section 2 as shown in FIGS. 35C and 35D (steps 28 and 29).

When generating a new analyzation parameter through interpolation with other analyzation parameter (such as parameter obtained in step 30), the analyzation parameters are interpolated in such a manner that their overtones correspond to each other, and thus, it is made possible to generate a noise-free new analyzation parameter (steps 31 and 32). After that, waveform synthesis process is performed on the basis of the newly generated parameter (step 33), so that new tone waveform data (PCM data) is synthesized (step 34). It should be understood that to obtain tone waveform data of desired frequency, it is sufficient that the synthesized tone waveform data is, after interpolation, shifted to a predetermined frequency and then resynthesized.

As has been described above, in accordance with the embodiment of FIGS. 32 to 35D, specific arrangements are made such that, when performing spectrum analyses at plural channels corresponding to a plurality of frequency bands, the same spectrum frequency component is never separated between two different channels. Thus, interpolation process and the like at the rear stages can be facilitated, and also desired intermediate tone colors can be generated by such an interpolation, thereby highly improving musical expression. Moreover, waveform interpolation process for each analyzation parameter can be done with no significant inconveniences, by allowing any specific spectrum to always be expressed in the form of analyzation parameter of any specific channel even when there occurs time-variation in the spectrum frequency.

What is claimed is:

1. A tone source device comprising:

memory means for storing analyzation parameters indicative of frequency and magnitude of respective spectra contained in each of plural frequency band areas of a predetermined audible reproduction region of plural data segments corresponding to a first tone waveform, said data segments being successive parts of the first tone waveform;

reading means for sequentially reading out the analyzation parameters for each of said data segments; and synthesization means for, for each of said data segments, forming synthesized tone waveform data on the basis of the analyzation parameters read out from said memory means.

2. A tone source device as defined in claim 1 which further comprises data shift operation means for performing arithmetic operations by shifting a value of frequency data contained in the analyzat ion parameter read out from sa id memory means, in accordance with control data.

3. A tone source device as defined in claim 1 which further comprises interpolation means for performing an interpolation on the analyzat ion parameters of the respective spectra between different waveforms.

4. A tone source device as defined in claim 1 which further comprises:

spectrum envelope data supplying means for supplying spectrum envelope data of a second tone waveform that is different from said first tone waveform read out from said memory means, and modification means for modifying magnitude data of respective spectra of the first tone waveform read out from said memory means, using the spectrum envelope data of the second tone waveform supplied by said spectrum envelope data supplying means, and wherein said synthesization means forms new synthesized tone waveform data on the basis of frequency data of the respective spectra of the first tone waveform read out from said memory means and the magnitude data of the respective spectra modified by said modification means.

5. A tone source device as defined in claim 1 which further comprises:

storage means for storing spectrum ratio envelope data indicative of a ratio of the spectrum envelope of a second tone waveform relative to a spectrum envelope of said first tone waveform, and modification means for modifying the magnitude data of the respective spectra of the first tone waveform read out from said memory means, by the spectrum ratio envelope data stored in said storage means, and wherein said synthesization means forms new synthesized tone waveform data on the basis of the frequency data of the respective spectra of the first tone waveform read out from said memory means and the magnitude data of the respective spectra modified by said modification means.

6. A tone source device as defined in claim 1 which further comprises control means for controlling said reading means to repeatedly read out the analyzation parameters corresponding to one or more of said data segments.

7. A tone source device as defined in claim 6 in which said control means is capable of variably designating the data segments corresponding respectively to a start point and an end point for repeated readout of the analyzation parameters, and said control means controls said reading means to repeatedly read out the analyzat ion parameters for a plurality of the data segments from the data segment corresponding to the start point to the data segment corresponding to the end point.

8. A tone source device as defined in claim 7 in which said control means is capable of changing the start and end points during the repeated readout of the analyzation parameters.

9. A tone source device as defined in claim 7 in which said control means is capable of designating, as the data segment corresponding to the start point, such a data segment that should, in a normal readout mode, be read out later than the data segment corresponding to the end point, so that the readout of the analyzation parameters for the plurality of the data segments is performed in an opposite direction to a direction followed in the normal readout mode.

10. A tone source device as defined in claim 1 which further comprises change means for, when a pitch of a tone to be generated is desired to be changed legato from a first pitch to a second pitch, progressively changing, with a predetermined characteristic, a value of the frequency data contained in the analyzat ion parameter read out from said memory means, from a value corresponding to the first pitch to a value corresponding to the second pitch.

11. A tone source device as defined in claim 10 which further comprises volume control means for controlling, with a predetermined characteristic, a volume of the synthesized tone waveform data formed by said synthesization means, when a pitch change control is performed by said change means.

12. A tone source device as defined in claim 1 in which said memory means stores the analyzation parameters each of said data segments, with respect to plural tone waveform data different at least in pitch, and said reading means reads out the analyzation parameters for each of said data segments, with respect to the plural tone waveform data corresponding to the tone to be generated, and which further comprises control means for, when a pitch of a tone to be generated is desired to be changed legato from a first pitch to a second pitch, controlling said reading means to start reading out the analyzation parameters corresponding to the second pitch, from the data segment corresponding to a segment order assigned to the data segment associated with the analyzation parameter that has been read out just before then with respect to the first pitch.

13. A tone source device as defined in claim 12 in which said control means controls said reading means so that if there is no data segment corresponding to said order with respect to the second pitch, said reading means starts reading out the analyzation parameters corresponding to the second pitch, from the data segment corresponding to a predetermined order.

14. A tone source device as defined in claim 13 which further comprises loop control means for controlling said reading means to repeatedly read out the analyzation parameters corresponding to one or more of the data segments, and where in said predetermined order is a segment order of the data segment corresponding to the start point for the repeated readout.

15. A tone source device as defined in claim 1 which further comprises means for supplying control data that is variable in control value represented thereby, and control means for variably controlling an interval at which the analyzation parameter for each of said data segments is sequentially read out by said reading means.

16. A tone source device as defined in claim 15 in which said control data is velocity data representative of intensity of a performance operation.

17. A tone source device as defined in claim 1 which further comprises:

vibrato analyzation means for analyzing a vibrato characteristic in the input tone waveform data so as to output vibrato waveform data corresponding to the analyzed vibrato characteristic;

vibrato memory means for storing the vibrato waveform data;

means for reading out the vibrato waveform data from the vibrato memory means, and modulation means for modulating frequency data contained in the analyzation parameters read out from said memory means, with the vibrato waveform data, whereby said synthesization means forms synthesized tone waveform data having a vibrato effect, by the modulated frequency data.

18. A tone source device as defined in claim 1 which further comprises adjustment means for adjusting at least one of frequency data and magnitude data that are contained in the analyzation parameter read out from said memory means, so that synthesized tone waveform data is formed by said synthesization means using the adjusted analyzation parameter.

19. A tone source device as defined in claim 18 in which said adjustment means comprises means for supplying as a time function a control parameter for respective spectra, and means for changing at least one of the frequency data and magnitude data contained in the analyzation parameter in accordance with the supplied control parameter.

20. A tone source device as defined in claim 18 in which said adjustment means comprises means for supplying a control parameter for each of the spectra as a function of control data provided from outside, and means for changing at least one of the frequency data and magnitude data contained in the analyzat ion parameter for each of said spectra in accordance with the supplied control parameter.

21. A tone source device as defined in claim 20 in which said control data provided from Outside is data that is provided in correspondence to intensity of a performance made by a performer.

22. A tone source device as defined in claim 1 which further comprises analyzation means for dividing data of the tone waveform into said plural data segments and analyzing each of said data segments to produce said frequency and magnitude of respective spectra contained therein.

23. A tone source device as defined in claim 22 which further comprises normalization means for normalizing original frequency data for the respective spectra obtained through the analyzation of said analyzation means, by shifting said original frequency data in accordance with a ratio of its fundamental frequency relative to a predetermined standard frequency, so that the frequency data normalized by said normalization means is stored into said memory means.

24. A tone source device as defined in claim 22 which further comprises normalization means for normalizing, using a predetermined standard magnitude, original magnitude data for the respective spectra obtained through the analyzation of said analyzation means, so that the magnitude data normalized by said normalization means is stored into said memory means.

25. A tone source device as defined in claim 24 in which said predetermined standard magnitude is a magnitude of an original fundamental frequency.

26. A tone source device as defined in claim 22 which further comprises first normalization means for normalizing original frequency data for the respective spectra obtained through the analyzation of said analyzation means, by shifting said original frequency data in accordance with a ratio of its fundamental frequency relative to a predetermined standard frequency, and second normalization means for normalizing original magnitude data for respective spectra obtained through the analyzation of said analyzation means, based on a magnitude of its fundamental frequency, so that the frequency data and magnitude data normalized by said first and second normalization means are stored into sa id memory means.

27. A tone source device as defined in claim 26 in which said second normalization means removes a positive or negative sign from the normalized magnitude data so as to express the data in an absolute value.

28. A tone source device as defined in claim 26 in which said first normalization means comprises means for shifting the frequency data for the respective spectra obtained through the analyzation of said analyzation means, in accordance with the predetermined standard frequency, means for synthesizing, via said synthesization means, tone waveform data on the basis of the shifted frequency data for the respective spectra and magnitude data corresponding thereto, and means for reanalyzing, via said analyzation means, the synthesized tone waveform data for each group of plural said data segments so as to obtain frequency data of the respective spectra having said standard frequency as a fundamental frequency.

29. A tone source device as defined in claim 26 in which the normalized frequency data and magnitude data for plural tone waveforms are stored into said memory means, and which further comprises interpolation means for performing interpolation on the normalized frequency data and magnitude data between different tone waveforms, to thereby obtain frequency data and magnitude data of respective spectra of a new tone waveform.

30. A tone source device as defined in claim 29 in which the frequency data and magnitude data of the respective spectra of the new tone waveform obtained by said interpolation means are stored into said memory means.

31. A tone source device as defined in claim 22 in which said analyzation means comprises:

first analyzation process means having a plurality of band-pass filter means that have pass bands corresponding to respective ones of predetermined frequency bands, said first analyzation process means inputting the data of the tone waveform into each of said band-pass filter means and analyzing spectrum frequency and magnitude of a passed output from each of said bandpass filter means, and second analyzation process means for, when any component corresponding to a same spectrum frequency is analyzed by said first analyzation process means across different ones of said said band-pass filter means, combining magnitude data of each sa id component associated with the same spectrum frequency to form frequency data and magnitude data of one spectrum.

32. A tone source device as defined in claim 22 in which said analyzation means comprises:

first analyzation process means having a plurality of band-pass filter means that have pass bands corresponding to respective ones of predetermined frequency bands, said first analyzation process means inputting the data of the tone waveform into each of said band-pass filter means and analyzing spectrum frequency and magnitude of a passed output from each of said bandpass filter means;

first control means for instructing said first analyzation means to analyze the data segments of the tone waveform which are input at individual ones of plural time zones that are sequentially timewise spaced from each other;

determination means responsive to analyzation data obtained for each of the time zones for determining that a certain spectrum frequency has moved from a band corresponding to a first one of said band-pass filters over to a band corresponding to a second one of said band-pass filters, when a first one of said time zones changes to a second one of said time zones, and second control means responsive to the determination of said determination means for carrying out an exchange of the pass bands between said first and second ones of said band-pass filters and then instructing said first analyzation process means to reanalyze the spectrum frequency and magnitude associated with either of said first and second ones of said time zones.

33. A tone source device as defined in claim 31 in which said analyzat ion further comprises:

first control means for instructing said first and second analyzation process means to perform analyzation on the data segments of said tone waveform which are input at individual ones of plural time zones that are sequentially timewise spaced from each other:

determination means responsive to analyzation data obtained for each of the time zones for determining that a certain spectrum frequency has moved from a band corresponding to a first one of said band-pass filters over to a band corresponding to a second one of said band-pass filters, when a first one of said time zones changes to a second one of said time zones, and second control means responsive to the determination of said determination means for carrying out an exchange of the pass bands between said first and second ones of said band-pass filters and then instructing said first analyzation process means to reanalyze the spectrum frequency and magnitude associated with either of said first and second ones of said time zones.

34. A tone source device as defined in claim 22 in which said analyzation means divides the data of the tone waveform into a plurality of frames along a time axis in such a manner that the frames are partly overlapped with each other timewise, and said analyzation means analyzes the frequency and magnitude of the respective spectra for each of the data segments of the tone waveform which correspond to said frame.

35. A tone source device as defined in claim 22 in which said analyzation means comprises:

plural channels each having band-pass filter means in such a manner that said filter means of said plural channels have pass bands corresponding to respective ones of predetermined frequency bands and data of the tone waveform is input into any of said band-pass filter means, said analyzation means analyzing, for each of plural time frames, spectrum frequency and magnitude of a passed output from each of said band-pass filter means so as to produce said analyzation parameters indicative of the frequency and magnitude of the respective spectra for each of data segments which correspond to said time frames.

36. A tone source device as defined in claim 35 in which said memory means stores the analyzation parameters of the respective channels which correspond to the time frames, said reading means reads out the analyzation parameters of the respective channels which correspond to a current time frame, and said synthesization means forms synthesized waveform data of data segments corresponding to the current time frame on the basis of the analyzation parameters of the respective channels.

37. A tone source device as defined in claim 1 which further comprises interpolation means for performing interpolation on the analyzation parameter between different ones of said data segments.

38. A tone source device as defined in claim 1 which further comprises shift means for shifting the frequency data contained in the analyzation parameters read out from said memory means, in accordance with a pitch of a tone to be synthesized.

39. A tone source device comprising:

spectrum data supplying means for supplying frequency data and magnitude data indicative of frequency and magnitude of respective spectra contained in each of plural frequency band areas of a predetermined audible reproduction region making up a first tone waveform;

spectrum envelope data supplying means for supplying spectrum envelope data of at least a second tone waveform;

modification means for modifying the magnitude data of the respective spectra of the first tone waveform supplied by said spectrum data supplying means, using the spectrum envelope data of the second tone waveform supplied by said spectrum envelope data; and synthesization means for synthesizing new tone waveform data on the basis of the frequency data of the respective spectra of the first tone waveform supplied by said spectrum data supplying means and of the magnitude data of the respective spectra modified by said modification means.

40. A tone source device as defined in claim 39 in which said spectrum envelope data supplying means further supplies spectrum envelope data of the first tone waveform, and said modification means comprises means for obtaining a ratio of the spectrum envelope data of the second tone waveform relative to the spectrum envelope data of the first tone waveform and also modifies the magnitude data of the respective spectra of the first tone waveform in accordance with the obtained ratio.

41. A tone source device as defined in claim 39 in which said spectrum data supplying means comprises :

analyzation means for dividing input tone waveform data into plural data segments and analyzing frequency and magnitude of the respective spectra for each of said data segments, and memory means for storing frequency and magnitude data of the respective spectra for each of said data segments, with respect to plural different ones of said tone waveform data.

42. A tone source device as defined in claim 41 in which said spectrum envelope data supplying means comprises means for analyzing an spectrum envelope of the input tone waveform data, and memory means for storing, with respect to plural different ones of said tone waveform data, the analyzed spectrum envelope data.

43. A tone source device comprising:

spectrum data supplying means for supplying frequency data and magnitude data indicative of frequency and magnitude of respective spectra contained in each of plural frequency band areas of a predetermined audible reproduction region making up a first tone waveform;

memory means for storing spectrum ratio envelope data indicative of a ratio of a spectrum envelope of a second tone waveform relative to a spectrum envelope of the first tone waveform, modification means for modifying the magnitude data of the respective spectra of the first tone waveform supplied from said spectrum data supplying means, by the spectrum ratio envelope data stored in said storage means, and synthesization means for forming new synthesized tone waveform data on the basis of the frequency data of the respective spectra of the first tone waveform supplied by said spectrum data supplying means and the magnitude data of the respective spectra modified by said modification means.

44. A method for synthesizing a tone comprising steps of:

analyzing frequency and magnitude of respective spectra contained in each of plural frequency band areas of a predetermined audible reproduction region contained in a given waveform for each of plural data segments that correspond to successive parts of the waveform;

storing analyzation parameters indicative of frequency and magnitude of the respective spectra for each of the data segments which are obtained through analyzation of said analyzing step;

reading out the stored analyzation parameters for each of said data segments in accordance with lapse of time, and forming, for each of said data segments, synthesized tone waveform data on the basis of the read-out analyzation parameters.

* * * * *